US005510767A

United States Patent [19]

Smith

[11] Patent Number: 5,510,767

[45] Date of Patent: Apr. 23, 1996

[54] GLASS BREAK DETECTOR HAVING REDUCED SUSCEPTIBILITY TO FALSE ALARMS

[75] Inventor: Richard A. Smith, Portland, Oreg.

[73] Assignee: Sentrol, Inc., Tualatin, Oreg.

[21] Appl. No.: 384,343

[22] Filed: Feb. 1, 1995

Related U.S. Application Data

[63] Continuation of Ser. No. 85,634, Jun. 30, 1993, abandoned.

[51] Int. Cl.[6] ..... G08B 13/00

[52] U.S. Cl. ..... 340/566; 340/550

[58] Field of Search ..... 340/566, 550, 340/544, 552–554; 367/93–94

[56] References Cited

U.S. PATENT DOCUMENTS

| | | | |
|---|---|---|---|
| 3,662,371 | 5/1972 | Lee et al. | 367/93 |
| 4,091,660 | 5/1978 | Yanagi | 73/658 |
| 4,134,109 | 1/1979 | McCormick et al. | 340/550 |
| 4,668,941 | 5/1987 | Davenport et al. | 340/550 |
| 4,837,558 | 6/1989 | Abel et al. | 340/550 |
| 4,853,677 | 8/1989 | Yarbrough et al. | 340/544 |
| 4,991,145 | 2/1991 | Goldstein et al. | 367/94 |
| 5,117,220 | 5/1992 | Marino et al. | 340/550 |
| 5,192,931 | 3/1993 | Smith et al. | 340/550 |

*Primary Examiner*—Thomas J. Mullen, Jr.
*Attorney, Agent, or Firm*—Stoel Rives

[57] ABSTRACT

A glass break detector system (10) includes a low frequency (LF) detector (28) that is responsive to a pressure wave transducer (12) to detect the amplitude of a low frequency, generally sinusoidal acoustic wave signal resulting from a physical contact with a glass window. The LF detector includes a peak analyzer (42) that compares absolute values of sequential first and second amplitudes (P1, P2) of a low frequency signal derived from the low frequency acoustic wave signal to determine an appropriate alarm response. The LF detector enables the alarm if the absolute value of the first amplitude (P1) is greater than the absolute value of the second amplitude (P2) or if P1 or P2 amplitudes exceed saturation thresholds. The LF detector also includes a slope analyzer (40) that determines whether the low frequency signal exhibits atypical characteristics that generally indicate glass breakage. The detector system includes mid-frequency and high frequency signal processing circuits to further reduce susceptibility to false alarms.

18 Claims, 13 Drawing Sheets

VCC
60K
12K
254
252
250
+1.25V
MN6
150K
MN8
WAKE
VSS
F02
MN12
MN10
F01
R40
144K
MN18
256
VCC
+300mV
+250mV
250
FVC
260
3K
C30
.1u
MN14
MN16
PSET
WAKE
NG
WAKE
258
240
FTV
FF
Q
32KHZ
FF
Q
230
234
232
238
236
242
244
F01
F02
FVC
268
272
NG
ACOUSTIC
LATCHDISABLE
270

GLASS BREAK DETECTOR HAVING REDUCED SUSCEPTIBILITY TO FALSE ALARMS

This is a continuation of application Ser. No. 08/085,634, filed Jun. 30, 1993, now abandoned.

TECHNICAL FIELD

The present invention relates to a glass break detector and, in particular, to a substantially false alarm immune acoustic wave signal detecting and processing device that enables an alarm upon detecting in a low frequency pressure or shock wave certain amplitude characteristics that are representative of breaking glass or chamber penetration.

BACKGROUND OF THE INVENTION

Acoustic waves are detected by currently available glass break detectors and intrusion detectors. Conventional glass break detectors of the acoustic wave type are designed to eliminate false alarms by detecting the presence of high and low frequency components of acoustic wave signals produced by breaking glass. U.S. Pat. No. 4,091,660 of Yanagi describes a glass break detector that enables an alarm whenever the detector detects the presence of acoustic wave signals of below 50 kHz and above 100 kHz.

Other devices are designed to detect the presence of different acoustic wave frequency components at different times. The premise underlying the operation of the detector described in U.S. Pat. No. 4,668,941 of Davenport et al. is that breaking glass produces an initial low frequency component centered around 350 Hz and a subsequent high frequency component centered around 6.5 kHz. The 6.5 kHz component is indicative of a tinkling sound of glass breaking as it falls to the ground and shatters. However, U.S. Pat. No. 4,837,558 of et al. points out the shortcomings of the Davenport et al. detector by emphasizing that breaking glass may not produce the tinkling sound, particularly if the glass pane or window is situated above a carpeted surface.

Conventional intrusion detectors detect an infrasonic pressure wave that accompanies the opening of a door or window. Such pressure waves may be detected by a sensitive microphone or other acoustic transducer having a frequency response in the region of 1–10 Hz. U.S. Pat. No. 4,853,677 of Yarbrough et al. describes such a device that also included a glass break detector circuit that is coupled to a microphone. An event causing either a high frequency or a low frequency signal having a predetermined frequency spectrum triggers an alarm. U.S. Pat. No. 4,991,145 of Goldstein et al. describes an acoustic intrusion detector that detects the opening of a door or window by responding to negative-going air pressure waves.

U.S. Pat. No. 5,192,931 of Smith et al. describes a glass break detector that includes an acoustic transducer having a wide band frequency response and coupled to a dual channel filter and signal processing circuit. A low frequency channel filter detects an initial positive compression acoustic wave caused by an inward motion of a glass window, and a high frequency channel filter detects an acoustic wave frequency spectrum that is characteristic of breaking glass. A coincidence logic circuit enables an alarm whenever the positive low frequency acoustic wave is detected during a predetermined time interval that begins with a high frequency event (i.e., a loud sound) generated by the breaking glass. The presence of a requisite high frequency spectrum of acoustic waves following the initial positive low frequency produced by the inward motion of the glass window triggers the alarm. The detector includes false alarm circuitry that inhibits the alarm upon the detection of an initial negative compression wave followed by high frequency sounds.

Although they take advantage of certain acoustic wave signal characteristics of breaking glass, the previously described glass breakage and intrusion detectors do not always inhibit false alarms that may be produced by events having frequency characteristics similar to those produced by breaking glass.

SUMMARY OF THE INVENTION

An object of the present invention is to provide a glass break detector that is less susceptible to false alarms by accurately discriminating the sound of an intrusion or breaking glass from other, spurious sounds.

Another object of the invention is to provide such a glass break detector that processes the low frequency component of a pressure or shock wave to reduce the probability of false alarm occurrences.

A further object of the invention is to provide such a glass break detector that can detect the breaking of several types of glass.

The present invention is a glass break detector having reduced susceptibility to false alarms. The invention includes a low frequency (LF) detector having signal processing circuitry that analyzes the amplitude waveform characteristics of a LF signal produced by a LF bandpass filter of a type similar to that implemented in the glass break detector described in U.S. Pat. No. 5,192,931, which is assigned to the assignee of this application. The LF signal has a characteristic waveform that includes two initial, time-displaced amplitude peaks, which are a first half-cycle amplitude peak, P1, followed by a second half-cycle amplitude peak, P2.

It has been empirically determined that a valid glass break event produces a LF signal for which the absolute value of P1 is greater than the absolute value of P2. This is true if a P1 of positive amplitude occurs within a 11.7 millisecond COINCIDENCE period initiated by a mid-frequency trigger event generated by the breaking glass. The signal processing circuitry implements the following set of decision rules to analyze an LF voltage signal and determine whether it represents a valid glass break event:

If P1 is greater than a predetermined positive LF threshold voltage and if the absolute value of P2 is less than that of P1; or If P1 is greater than a predetermined positive LF saturation threshold voltage; or If P2 is less than a predetermined negative saturation threshold voltage; or If after a P1 of sufficient amplitude occurs, the LF signal undergoes a change in polarity of voltage slope anywhere above or below a predetermined acoustic background noise threshold before the P2 half-cycle.

The signal processing circuitry produces electrical signals indicative of the four conditions the above decision rules represent. A LF logic subcircuit cooperates with a set of voltage threshold comparators to determine whether an event produced an LF signal with a P1 of certain positive amplitudes occurring within the COINCIDENCE period. A slope analyzer and a peak analyzer concurrently process a LF signal meeting these event criteria. The slope analyzer indicates whether the LF signal determined to be valid by the LF logic subcircuit had two amplitude peaks prior to the occurrence of P2. The presence of the two amplitude peaks indicates a VALID LF signal, which is defined as representing a valid glass break event, and interrupts the operation of the peak analyzer. In the event the slope analyzer determines no such two amplitude peaks occurred, the peak analyzer proceeds to determine whether the absolute value of P1 is greater than the absolute value of P2 or whether the value of P2 is less than a predetermined negative saturation voltage. Either one of these two conditions indicates a valid LF signal. Any one of these conditions produces a VALID LF signal that enables an alarm with a low probability of false alarm occurrence.

In a preferred embodiment, a mid-frequency (MF) bandpass filter produces a TRIGGER signal in response to a minimum voltage MF signal (4.8 kHz) component of the microphone signal produced by a potential glass break event. The TRIGGER signal initiates the COINCIDENCE period and LF signal processing summarized above.

The preferred embodiment uses two additional criteria together with the presence of the VALID LF signal to enable the alarm. The first is high frequency (HF) bandpass filter that produces a sustained HF signal for the remaining time of a 78 millisecond NOISE GATE (NG) period following the start of the COINCIDENCE period. The second is the persistence of the MF signal substantially continuously throughout the NG period after the TRIGGER signal.

Finally, a verification pulse signal appears at the end of the NOISE GATE period to enable the alarm if the VALID LF signal and signals corresponding to the MF and HF signals are simultaneously present at that time.

Additional objects and advantages of the present invention will be apparent from the following detailed description of a preferred embodiment thereof, which proceeds with reference to the accompanying drawings.

DETAILED DESCRIPTION OF PREFERRED EMBODIMENT

Figure 1:
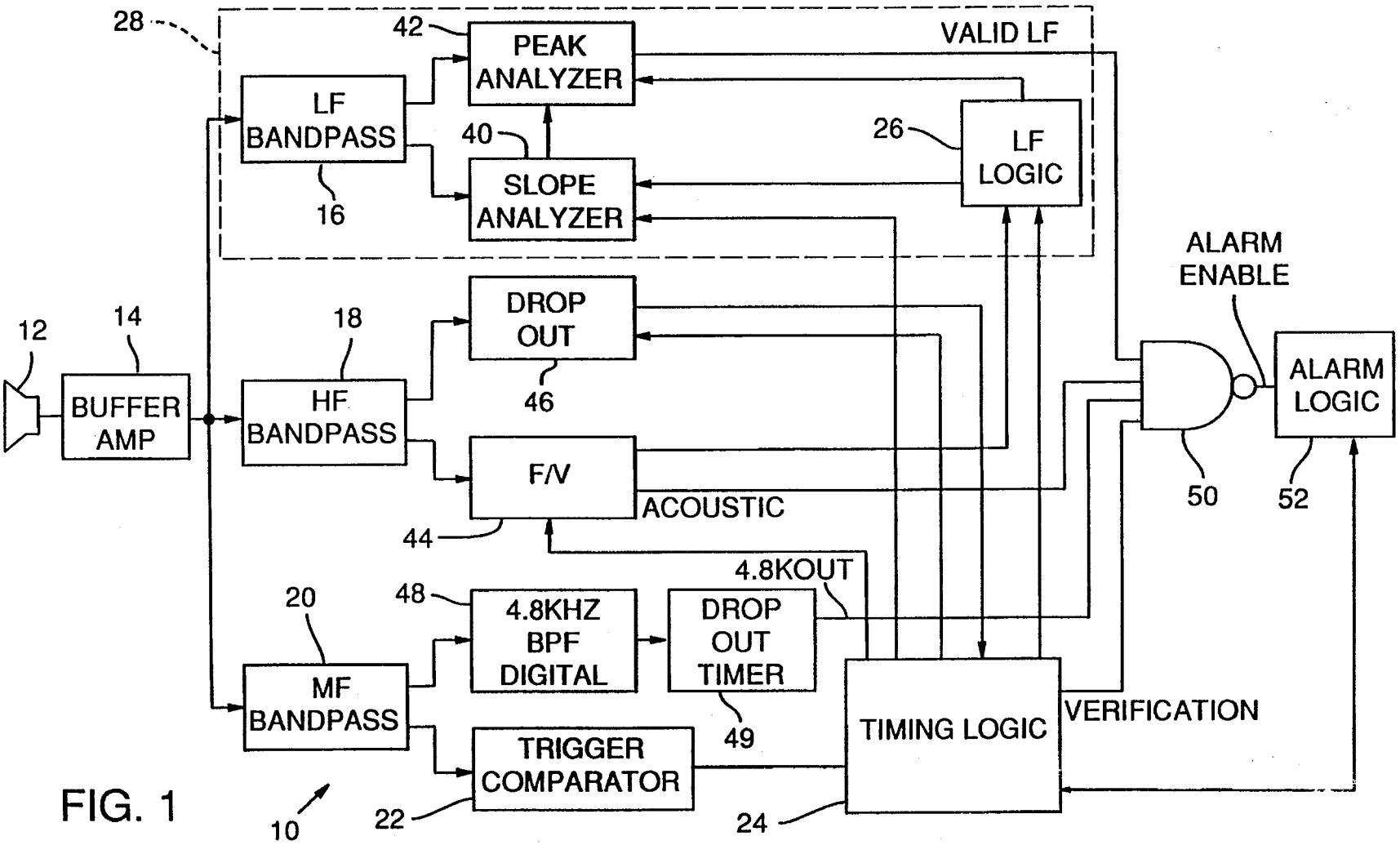
FIG. 1 is a block schematic diagram of a glass break detector system of the present invention.

FIG. 1 is an overall block diagram of a preferred glass break detector system 10 designed in accordance with the invention. With reference to FIG. 1, glass break detector system 10 includes a pressure wave transducer or microphone 12 whose output signal is connected through a voltage follower buffer amplifier 14 to the inputs of a low frequency (LF) bandpass filter 16, a high frequency (HF) bandpass filter 18, and a mid-frequency (MF) bandpass filter 20. Microphone 12 is suitably positioned near a glass window or pane to produce an output signal whose amplitude and frequency carry the information the signal processing circuits of glass break detector system 10 analyze to determine whether the output signal represents the sound of breaking glass.

A trigger comparator 22 connected to the output of MF filter 20 produces a TRIGGER signal upon the initial detection of a mid-frequency (4.8 kHz) component of sufficient amplitude of the output signal of microphone 12. The TRIGGER signal enables the production of a 78 millisecond NOISE GATE (NG) signal and an 11.7 millisecond COINCIDENCE signal in a timing logic circuit 24. The NG and COINCIDENCE signals are directed to a LF logic circuit 26 that cooperates with a low frequency detector 28 to analyze the frequency components of the LF output signal of LF filter 16 and determine whether they meet the criteria for a valid glass break event. LF logic circuit 26 and a peak analyzer 42 include several threshold comparators that produce predetermined logic states in response to different threshold voltage levels of the LF signal. To have a valid glass break event, LF filter 16 must produce within the 11.7 millisecond COINCIDENCE period a LF signal whose amplitude waveform exhibits certain predetermined characteristics. Whenever they determine that P1 is of a predetermined positive amplitude or exceeds a predetermined positive saturation threshold, the threshold comparators and associated logic subcircuits in LF logic circuit 26 cause the production of a VALID 1 signal that starts an analysis of the amplitude waveform characteristics of the LF signal.

The analysis of the LF signal is performed concurrently by a slope analyzer 40 and a peak analyzer 42. Slope analyzer 40 determines whether there is a double peak in the LF signal waveform before the occurrence of P2. If two such peaks occur, slope analyzer 40 produces a VALID 2 signal and causes the production of a VALID LF signal, the latter of which signifies that information derived from the LF signal indicates a valid glass break event has occurred. (In the preferred embodiment, whether there has been a valid glass break also requires analyses of the HF output signal of HF filter 18 and of the MF output signal of MF filter 20, as will be described below.) The VALID 2 signal interrupts the operation of peak analyzer 42. If no two such peaks occur, peak analyzer 42 determines the relative absolute values of P1 and P2 and causes the production of a VALID LF signal whenever (1) the absolute value of P1 is greater than that of P2 or (2) the value of P2 is less than a predetermined negative saturation threshold. Peak analyzer 42 produces a VALID LF signal whenever VALID 1 is present and either of the above-defined conditions (1) or (2) has been met.

HF filter 18 provides the HF signal to a frequency-to-voltage (F/V) converter 44, which has an initial bias voltage stored across a capacitor whose instantaneous voltage changes in response to the frequency of the HF signal. A threshold comparator included within F/V converter 44 sets a threshold voltage with which the changing voltage is compared. If the changing voltage exceeds the threshold voltage for the remaining portion of the 78 millisecond NG period measured after the 11.7 millisecond COINCIDENCE period, a latch provided at the output of F/V converter 44 is in a logic state that indicates the presence of a high frequency signal of at least a minimum average frequency. HF filter 18 provides the HF signal to a comparator and drop out timer 46 to detect whether the signal drops out for more than 15.625 milliseconds. Drop out timer 46 causes processing to cease and NG to become an invalid logic state if the HF signal drops below a threshold for more than 15,625 milliseconds. The latch then produces an ACOUSTIC signal in a logic state that indicates the absence of a valid glass break event.

MF filter 20 provides the MF signal to a digital bandpass filter 48 having a 4.8 kHz center frequency. Digital filter 48 produces a series of pulses whenever the MF signal exceeds a threshold voltage and has a repetition rate corresponding to a range of 3 kHz to 6 kHz. Digital filter 48 includes a counter and a drop out timer 49 that cooperate to record 192 counts in a specified sequence to produce a 4.8KOUT signal that indicates a possible glass break event.

Timing logic circuit 24 produces a VERIFICATION pulse signal upon the conclusion of the NG period to serve as a gating signal of a NAND gate 50 described below.

The VALID LF output signal of peak analyzer 42, the ACOUSTIC signal at the output of F/V converter 44, the 4.8KOUT signal of drop out timer 49, and the VERIFICATION signal of timing logic circuit 24 are applied to different inputs of four-input NAND gate 50, whose ALARM ENABLE output signal drives a conventional alarm logic circuit 52. The ALARM ENABLE signal becomes a logic 0 when all four of the inputs of NAND gate at the same time are in logic 1, which condition indicates a valid glass break event. An ALARM ENABLE signal in logic 0 enables alarm logic circuit to actuate an external security system and visual alarm.

Figure 2:
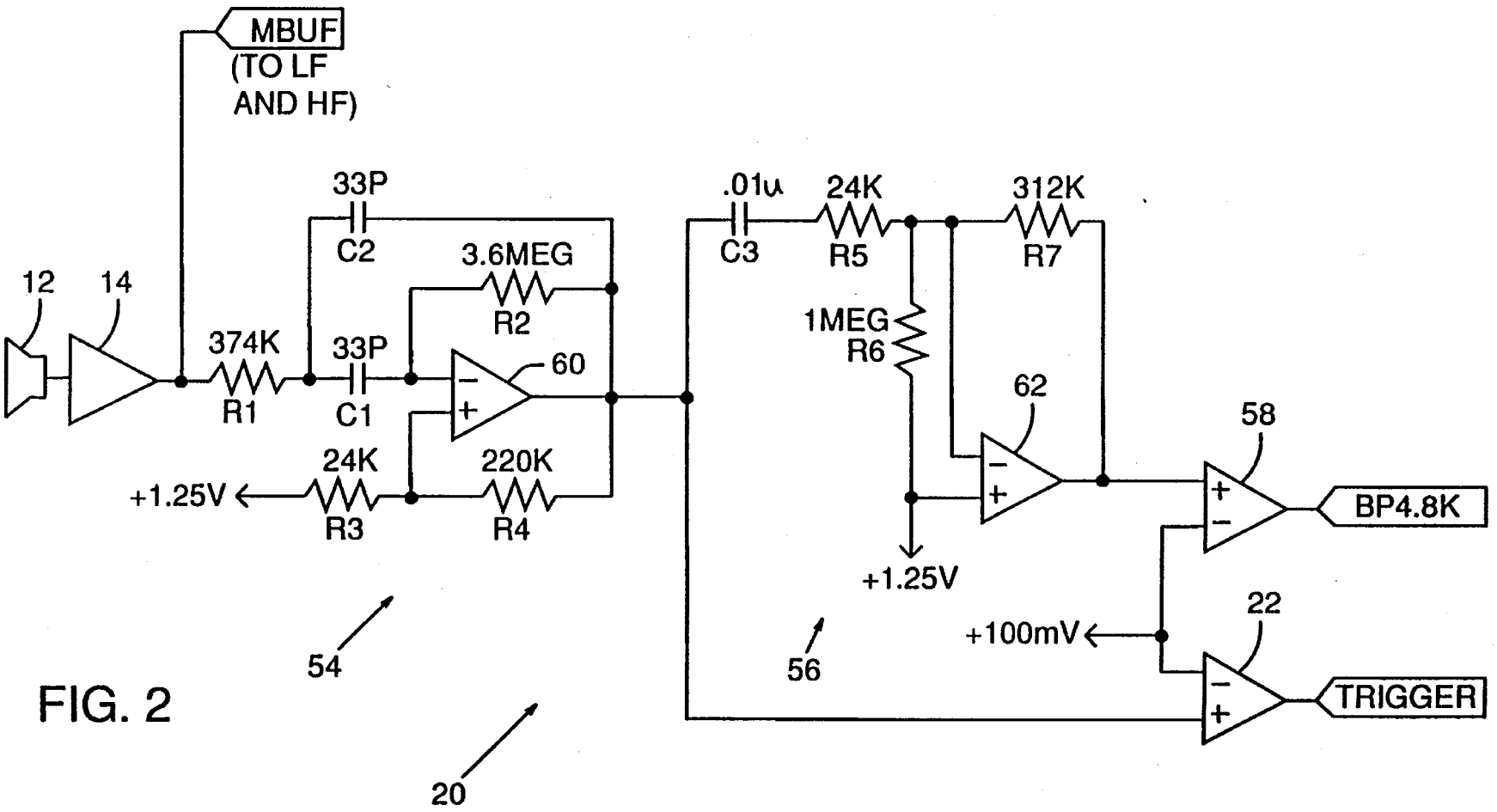
FIG. 2 is a schematic diagram of MF bandpass filter and trigger comparator shown in FIG. 1.

With reference to FIG. 2, microphone 12 is preferably of an electric type whose ±3 dB frequency response ranges from between 20 Hz and 15 kHz and whose output voltage polarity is positive for an increase in atmospheric pressure and negative for a decrease in atmospheric pressure. Microphone 12 also preferably has a wide dynamic range of greater than 120 dB, and an omni-directional pickup pattern.

The output of buffer amplifier 14 is coupled to MF filter 20, which comprises two amplifier stages 54 and 56 connected in cascade arrangement. The output of amplifier stage 54 provides the MF signal to the input of trigger comparator 22, and the output of amplifier stage 56 provides an inverted MF ($\overline{MF}$) signal to a comparator 58 that forms the input of digital bandpass filter 48. Each of comparators 22 and 58 receives at its inverting input a 100 millivolt threshold voltage and functions as a single bit analog-to-digital converter that transforms to bi-level signals the analog signal of changing amplitude applied to the noninverting input.

Amplifier stage 54 includes capacitors C1 and C2; resistors R1, R2, R3, R4; and an amplifier 60 to form a moderately high Q (of about 5) active bandpass filter with gain. Capacitors C1 and C2 and resistors R1 and R2 form a 4.8 kHz pole. The MF signal appearing at the output of amplifier 60 is applied to the noninverting input of trigger comparator 22, which produces at its output the TRIGGER signal in logic 1 whenever the MF signal exceeds the +100 millivolt threshold. The MF signal is also applied to the input of amplifier stage 56.

Amplifier stage 56 includes capacitor C3; resistors R5, R6, and R7; and an amplifier 62 to form an inverting amplifier that produces at its output the $\overline{MF}$ signal, which is applied to the noninverting input of input comparator 58 of digital filter 48. Comparator 58 provides at its output a BP4.8K signal in logic 1 whenever the $\overline{MF}$ signal exceeds the +100 millivolt threshold. The role of the BP4.8K signal is explained later.

Figure 3:
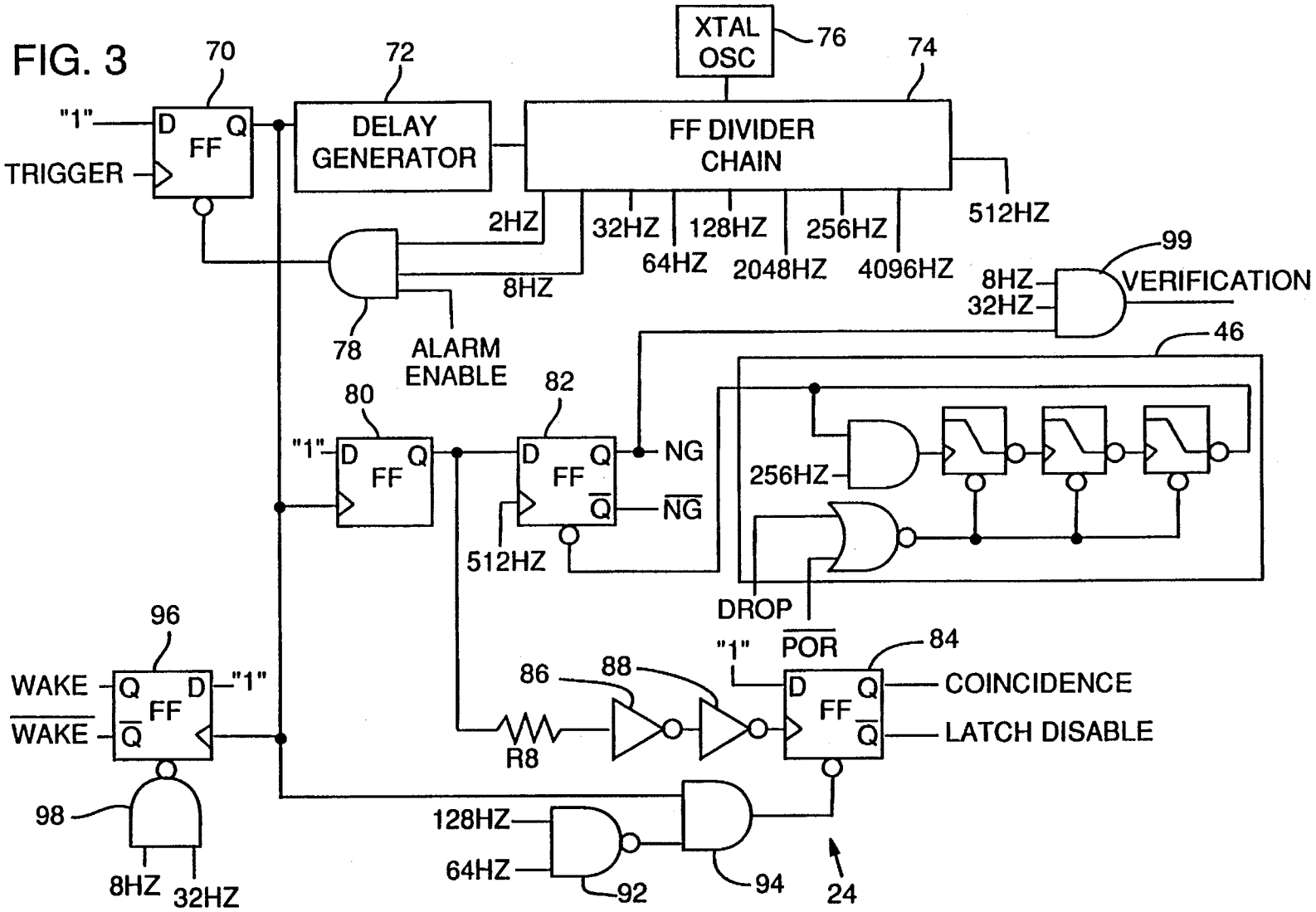
FIG. 3 is a logic diagram of the timing logic circuit shown in FIG. 1.

FIG. 3 shows timing logic circuit 24, whose operation is triggered by a mid-frequency event that is represented by an MF signal of sufficiently high amplitude (greater than +100 millivolts) to produce the TRIGGER signal in logic 1 at the output of comparator 22 and thereby start the signal processing of detector system 10. With reference to FIG. 3, the initial change of the TRIGGER signal from logic 0 to logic 1 clocks a logic 1 to the Q output of an initially reset D flip-flop 70. This transition activates a pulse generator 72 to produce a 1 microsecond delay that provides an enable signal for a crystal oscillator-driven frequency divider chain 74 of flip-flops on whose outputs appear various clock frequencies used by the processing circuitry of detector system 10. Divider chain 74 receives a 32.768 kHz (hereinafter 32 kHz) clock from a crystal oscillator 76.

Flip-flop 70 receives at its reset input a 312.5 millisecond logic 1 pulse produced at the output of an AND gate 78 by the timing relationship of 8 Hz and 2 Hz signals applied to its inputs. This prevents flip-flop 70 from changing logic states for 312.5 milliseconds whenever detector system 10 produces no alarm signal in response to a TRIGGER signal.

Upon the appearance of the TRIGGER signal, the Q output of D flip-flop 70 clocks a logic 1 to the Q output of a D flip-flop 80, whose Q output is applied to the D input of a D flip-flop 82 and to the clock input of a D flip-flop 84. The Q output of flip-flop 80 changes to logic 1 about 977 microseconds after the TRIGGER signal sets flip-flop 70 to logic 1. The Q output of flip-flop 82, on which output appears the NG signal, responds with a logic 1, and the Q output of flip-flop 84, on which output the COINCIDENCE signal appears, responds with a logic 1 about 115 nanoseconds after the NG signal. The 115 nanosecond delay of the COINCIDENCE signal results from series-connected resistor R8 and inverters 86 and 88 that slow the switching response of flip-flop 84.

The NG signal defines a nominal 78 millisecond period following the TRIGGER signal. The NG period is the time during which the signal processing circuits of detector system 10 determine whether a valid glass break event occurred in response to the TRIGGER signal. The COINCIDENCE signal defines an 15.625 millisecond period following the TRIGGER signal. The COINCIDENCE period is the time during which LF detector 28 determines whether P1 has an amplitude that exceeds a positive threshold to allow signal processing of detector system 10 to proceed.

The duration of the NG signal in logic 1 is established by the operation of drop out timer 46 that receives a DROP signal from an output comparator 90 of HF filter 18. The DROP signal indicates whether an HF signal of sufficient energy is present. Drop out timer 46 determines whether an HF signal of sufficient strength is continuously absent for more than 15.625 milliseconds at any time during the nominal 78 millisecond NG period. If the HF signal of sufficient energy and duration is absent, the DROP signal will not cause drop out timer 46 to reset flip-flop 82. Under these conditions, drop out timer 46 uses the 512 Hz clock to reset flip-flop 82 after 78 milliseconds have elapsed from the TRIGGER signal.

The COINCIDENCE signal remains in logic 1 for 11.7 milliseconds. This is accomplished by the resetting of flip-flop 84, which receives at its reset input a logic 0 signal 11.7 milliseconds after the TRIGGER signal. The reset signal is produced at the output of an NAND gate 92 through an AND gate 94 by the timing relationship of 128 Hz and 64 Hz signals applied to the inputs of NAND gate 92.

Figure 11:
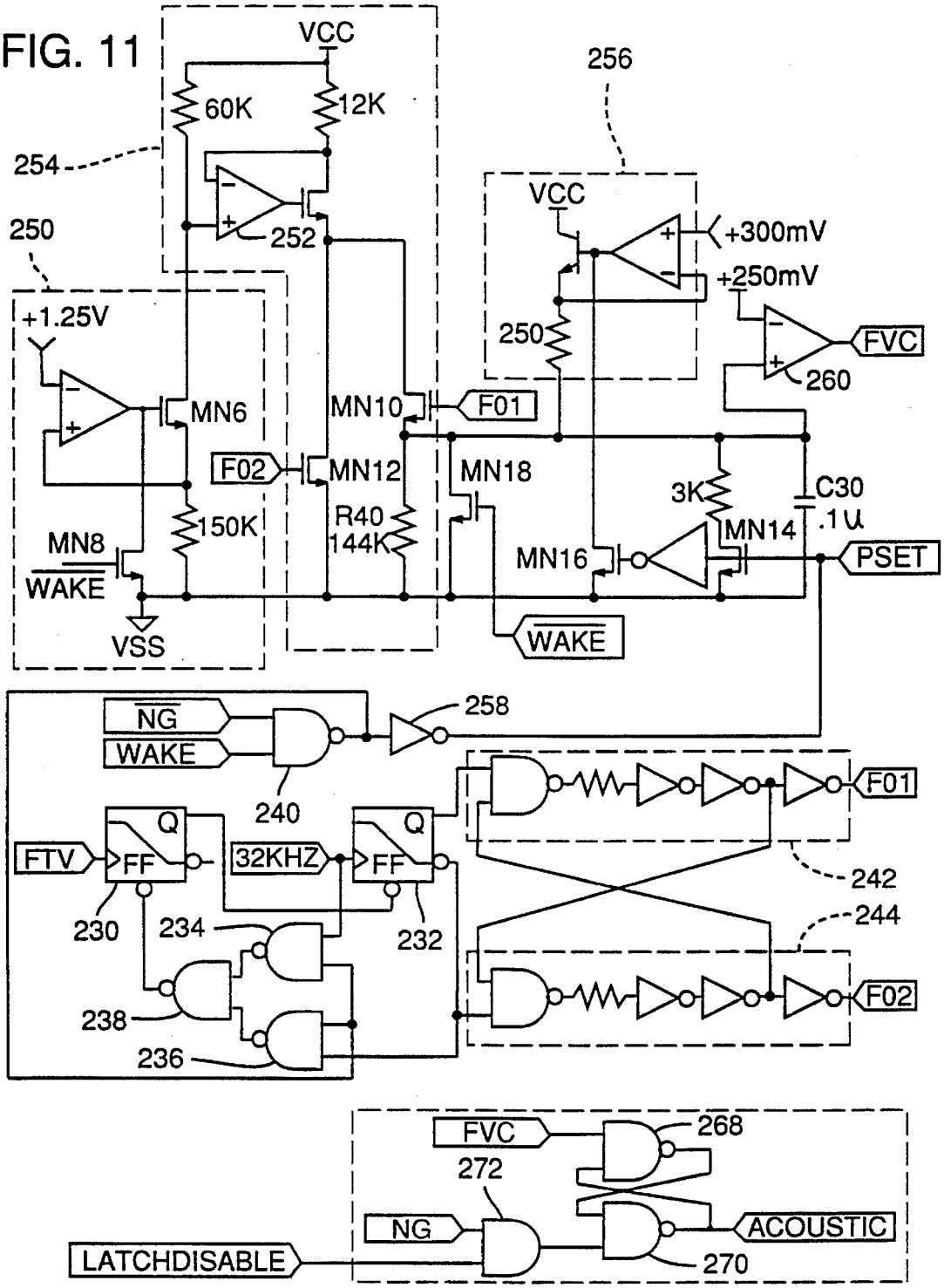
FIG. 11 is a schematic diagram of the F/V circuit shown in FIG. 1.

The clock input of a D flip-flop 96 is also connected to the Q output of flip-flop 70 to produce a WAKE signal in response to the TRIGGER signal. The WAKE signal appears at the Q output of flip-flop 96 and provides start-up signals for F/V converter 44 (FIG. 11). Flip-flop 96 is reset by the signal produced at the output of an AND gate 98, whose inputs are the 32 Hz and 8 Hz clocks. The reset pulse produced by AND gate 98 causes the WAKE signal to be in logic 1 for about 78 milliseconds after the TRIGGER signal.

A 3-input AND gate 99 receives at its inputs the NG signal and 32 Hz and 8 Hz clocks to produce a 977 microsecond VERIFICATION pulse 78 milliseconds after the TRIGGER signal. The VERIFICATION pulse is applied as a gating signal for NAND gate 50 to determine whether the requisite input signals are present to enable alarm logic circuit 52.

Upon the production of the NG and COINCIDENCE signals, the LF, HF, and MF signals are concurrently processed to determine whether a valid glass break event occurred.

Figure 4:
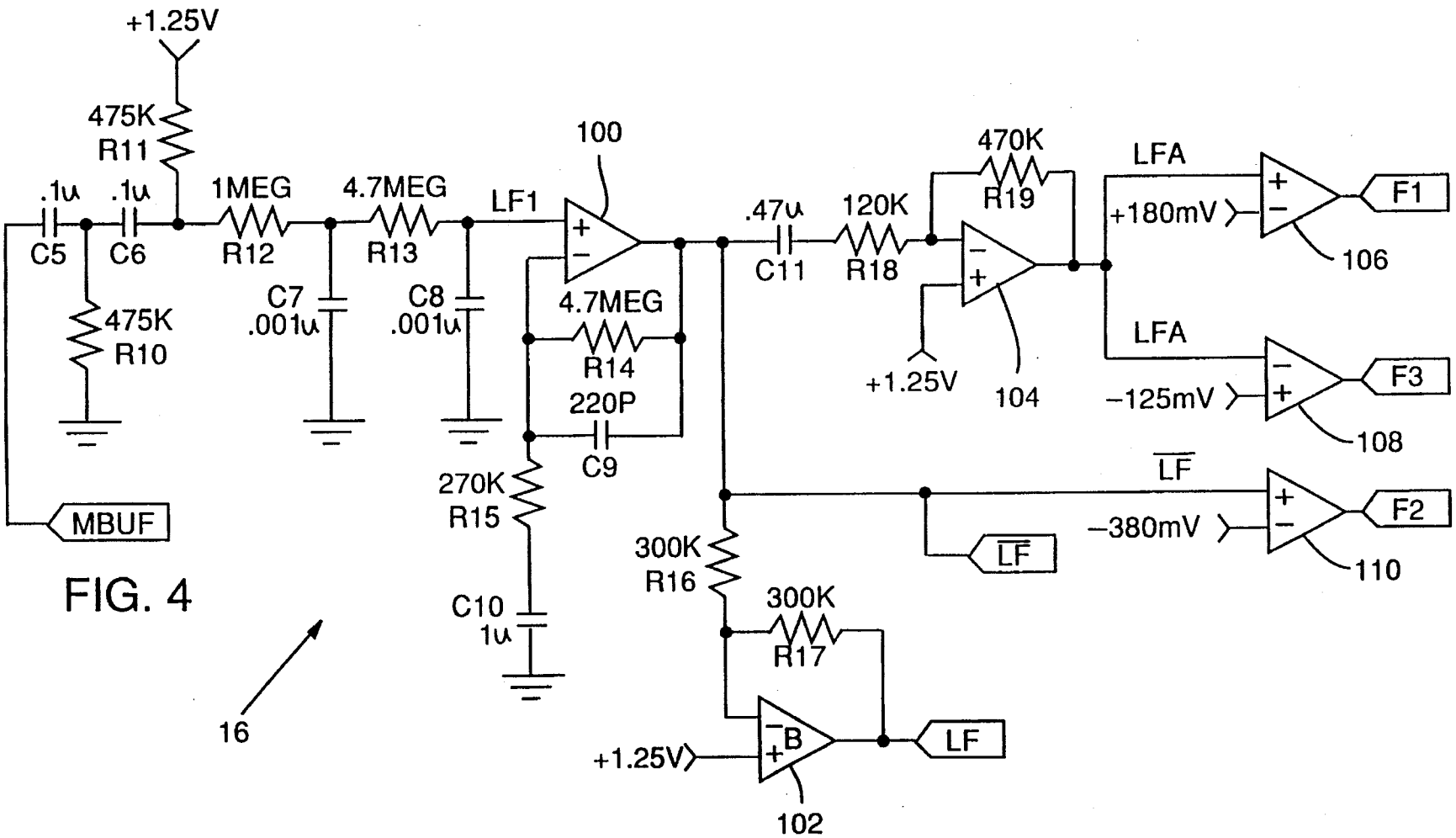
FIG. 4 is a schematic diagram of the LF bandpass filter shown in FIG. 1.

With reference to FIG. 4, the output of buffer amplifier 14 (FIG. 2) is also connected to LF filter 16, which includes a passive resistance-capacitance network and an amplifier 100 having an appropriate feedback network. The passive resistance-capacitance network includes capacitors C5 and C6 and resistors R10 and R11 that determine a high pass pole at about 3.4 Hz, and capacitors C7 and C8 and resistors R12 and R13 that determine a low pass pole at 34 Hz. Amplifier 100 and its feedback capacitors C9 and C10 and resistors R14 and R15 form a low pass pole at 154 Hz. LF filter 16 has a frequency response that emphasizes the 50 Hz to 100 Hz region because it has been empirically determined that the initial signal made by the motion of the glass just prior to its being broken produces at the output of microphone 12 signals within this frequency range. Moreover, the positive pressure wave resulting from the initial inward motion just prior to a break is of a higher magnitude than that resulting from an outward rebound, especially for tempered glass breaks. Whenever tempered glass breaks, the outward rebound after the initial inward motion is highly damped; therefore, detection schemes that are triggered by either an outward rebound or by cycle counting may fail to detect many such breaks. The output of amplifier 100 provides a signal in the low frequency region that naturally occurs in most types of glass breaks.

The signal produced at the output of amplifier 100 is applied to a unity gain inverting amplifier 102 and an inverting amplifier 104 with a gain of about 4. Resistors R16 and R17 set the gain of amplifier 102, and resistors R18 and R19 set the gain of amplifier 104. The outputs of amplifiers 100, 102, and 104 are applied to certain inputs of several comparators and amplifiers of the subcircuits of LF detector 28. The LF signal appears at the outputs of amplifiers 102 and 104, and an inverted ($\overline{LF}$) signal appears at the output of amplifier 100. (The output of amplifier 104 is sometimes referred to as the "LFA signal" because it is an amplified version of the output of amplifier 102.) The cooperative action of slope analyzer 40 (FIG. 7) and peak analyzer 42 (FIG. 9) make detector system 10 less susceptible to false alarms.

Comparators 106 and 108 receive at their respective noninverting and inverting inputs the LFAC signal from the output of amplifier 104, and a comparator 110 receives at its noninverting input the LF signal from the output of amplifier 100. Comparator 106 detects pressure waves associated with objects breaking a window, and its low frequency threshold amplitude (LFTA) is set sufficiently low (+180 millivolts) to detect worst case low frequency signals. This is so because it has been empirically determined that tempered glass, especially, generates a positive pressure wave that is much lower in amplitude than pressure waves caused by breaking plate and laminated glass. Comparator 110 detects high level pressure waves above a low frequency saturation amplitude (LFSA) (+380 millivolts) created in very small rooms or airlocks, which pressure waves would be detected before a window or pane actually breaks. Comparator 108 is part of an inhibit network that detects negative pressure that is not associated with breaking glass. Therefore, the threshold of comparator 108 is a negative voltage (−125 millivolts). The outputs of comparators 106, 108, and 110 are analyzed in LF logic circuit 26 to determine whether a strike to a window produces a VALID LF signal. Even though a window moves before it breaks, the high frequencies of the break reach their peaks in the circuitry before the low frequency pressure wave resulting from a valid window break reaches its peak; therefore, the high frequencies are more easily detectable first. It has been empirically determined that a valid low frequency signal is always detectable within less than 10 milliseconds after detection of the first high frequency components of microphone 12 output signals indicative of a glass break.

Thus, LF logic circuit 26 determines whether the LFA signal of amplifier 104 is positive- or negative-going during the first 11.7 milliseconds (i.e., the COINCIDENCE period) following the TRIGGER signal produced at the output of MF filter 20. Such a positive-going signal indicates that it is a VALID LF signal.

Figure 5:
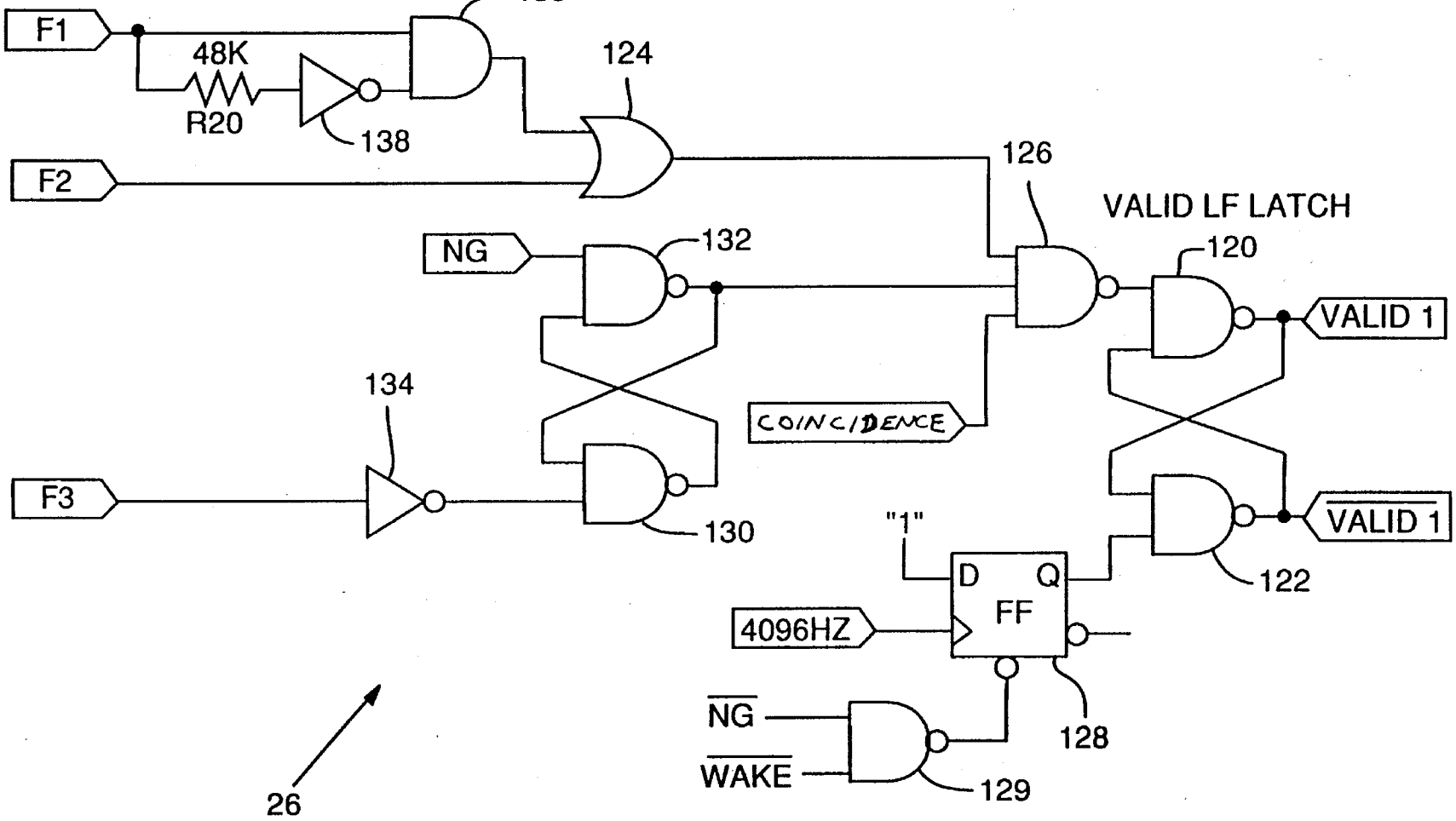
FIG. 5 is a logic diagram of the LF logic circuit shown in FIG. 1.

With reference to FIG. 5, LF logic circuit 26 includes an LF valid latch formed of cross-coupled NAND gates 120 and 122 that produces a logic 1 "VALID 1" signal at the output of NAND gate 120. This occurs whenever one of the outputs of comparators 106 and 110 switches to a logic 1 during the COINCIDENCE period before the output of comparator 108 switches to a logic 1. LF logic circuit 26 is implemented as follows to develop the VALID 1 signal.

The outputs of comparators 106 and 110 are, respectively, indirectly and directly connected to the inputs of an OR gate 124, whose output is applied to an input of a 3-input NAND gate 126. (The output of comparator 106 is connected through a pulse generator to OR gate 124, for the reasons given later.) Because the outputs of comparators 106 and 110 are normally in logic 0, the outputs of OR gate 124 and NAND gate 126 are normally in logic 0 and logic 1, respectively. These conditions cause a logic 1 to be normally applied to the SET input of NAND gate 120. The RESET input of NAND gate 122 is connected to the Q output of a D flip-flop 128. Flip-flop 128 is held in reset by the output of a NAND gate 129 for all time the $\overline{NG}$ and $\overline{WAKE}$ signals are in logic 1 and is clocked to a logic 1 at its Q output 122 microseconds (½×4096 Hz) after the WAKE signal changes to logic 0. Because the Q output of flip-flop 128 is normally in logic 0, the outputs of NAND gates 120 and 122 are normally in logic 0 and logic 1, respectively. Thus, the LF valid latch is normally in reset during the time outside of the COINCIDENCE period.

Another latch formed by cross-coupled NAND gates 130 and 132 indicates whether a negative-going LF signal occurs prior to a positive P1 half-cycle. The output of comparator 108 normally in logic 0 is inverted by an inverter 134 and then applied to the reset input of NAND gate 132. Because the NG input of NAND gate 132 is normally in logic 0 before the TRIGGER signal occurs, the output of NAND gate 132 is normally in logic 1.

Whenever one of the outputs of comparators 106 and 110 switches to a logic 1 before the output of comparator 108 switches to a logic 0 during the COINCIDENCE period, the output of OR gate 124 changes from logic 0 to logic 1. Because the COINCIDENCE signal applied to an input of NAND gate 126 is in logic 1 during the COINCIDENCE period and the output of NAND gate 132 is logic 1 when the inverted output of comparator 108 is in logic 1, the output of NAND gate 126 switches from logic 1 to logic 0. This causes the output of NAND gate 120 to switch from logic 0 to logic 1 and thereby set the VALID 1 signal to logic 1.

As was mentioned above, the output of comparator 106 is indirectly connected to OR gate 124 through a pulse generator. This is done because the threshold voltage applied to comparator 106 is the positive voltage and comparator 106 could respond for only a relatively long time to a LF signal. To facilitate processing and analysis of the LF signal, the pulse generator develops a 1 microsecond logic 1 pulse in immediate response to a transition from logic 0 to logic 1 at the output of comparator 106.

The pulse generator includes a 2-input AND gate 136 both of whose inputs are connected to the output of comparator 106, one directly connected and the other connected through a delay element formed by a series-connected resistor R20 and inverter 138. Whenever the output of comparator 106 is in logic 0, which is the usual condition, the outputs of inverter 138 and AND gate 136 are in logic 1 and logic 0, respectively. Whenever the output of comparator 106 switches from logic 0 to logic 1, the output of AND gate 136 switches to logic 1 for the length of time (1 microsecond) it takes AND gate 136 to react to the switching of inverter from logic 1 to logic 0. The length of time AND gate 136 remains in logic 1 is set by the value of resistor R20 and the sum of the propagation delay times of AND gate 136 and inverter 138.

Whenever the output of comparator 108 switches to logic 1 before one of the outputs of comparators 106 and 110 switches to a logic 1 during the COINCIDENCE period, the outputs of NAND gates 130 and 132 change from logic 0 to logic 1 and from logic 1 to logic 0, respectively, to prevent the output of NAND gate 126 from changing from its normal logic 1 state. The output of NAND gate 120 remains in logic 0, irrespective of a later change in the logic state of the output of OR gate 124, and thereby maintains reset of the VALID 1 signal in logic 0.

The production of a VALID 1 signal in logic 1 causes the analyses of the LF signal to be performed by slope analyzer 40 and peak analyzer 42 to determine whether the LF signal represents a valid glass break. FIGS. 6A–6E show various characteristic waveforms of the LF signal that slope analyzer 40 and peak analyzer 42 receive and process. With reference to FIGS. 6A–6D, the LF signal produced at the output of LF filter 16 has one of several characteristic patterns caused by acoustic waves generated by window motion in response to specific physical events. In FIGS. 6A–6D, P1 and P2 designate the voltage amplitudes of, respectively, the first half-cycle and the second half-cycle of an LF signal.

Figure 6A:
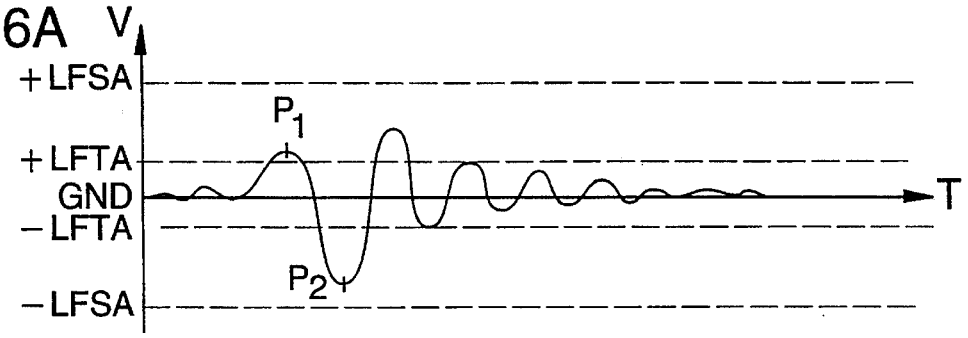
FIGS. 6A and 6B depict typical low frequency bandpass filter output signals produced in response to a physical impact force against the outside and inside, respectively, of a window without glass breakage.
Figure 6B:
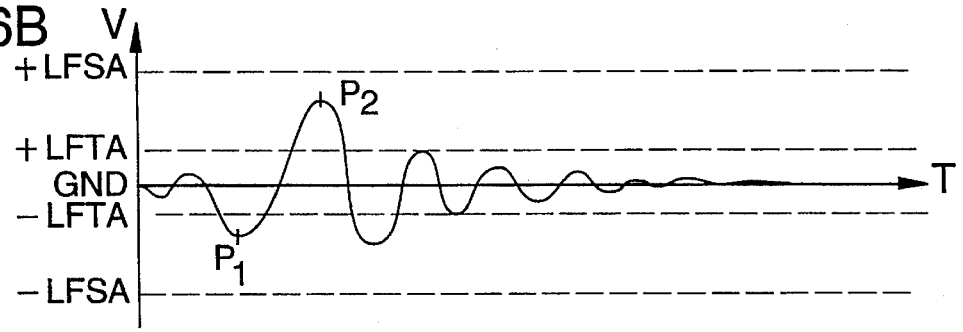

FIGS. 6A and 6B depict an LF signal produced in response to a physical impact force against, respectively, the outside of a window without glass breakage and the inside of a window without glass breakage. In both instances of physical contact without glass breakage, the absolute value of P2 is greater than that of P1; the absolute value of P1 is greater than the absolute value of the LF threshold amplitude (LFTA); and the absolute value of P2 is less than the absolute value of the LF saturation amplitude (LFSA).

Figure 6C:
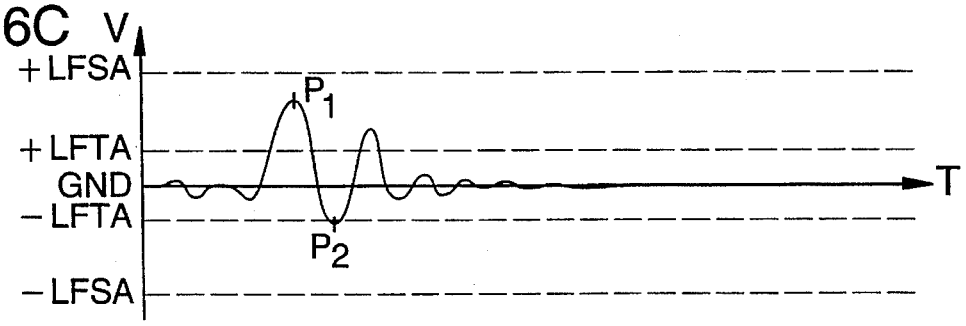
FIGS. 6C and 6D depict typical low frequency bandpass filter output signals produced in response to a typical glass window break caused by a physical impact force from the outside and inside, respectively, of the window.
Figure 6D:
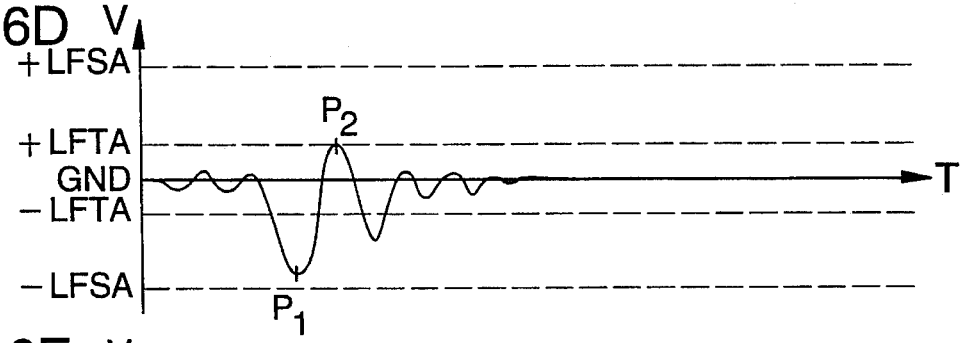

FIGS. 6C and 6D depict an LF signal produced in response to a typical window break caused by a physical impact force from, respectively, the outside and the inside. In both instances of physical contact resulting in glass breakage, the absolute value of P1 is greater than that of P2.

Figure 6E:
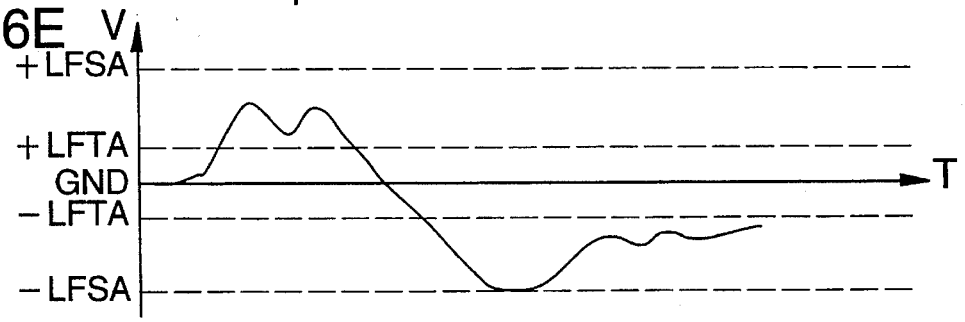
FIG. 6E depicts an exemplary low frequency bandpass filter output signal characterized by changes in polarity of voltage slope above an acoustic noise background threshold prior to the negative half-cycle of the signal.

FIG. 6E depicts an LF signal having changes in polarity of voltage slope above an acoustic background prior to P2 exceeding the absolute value of PI. This situation may appear in glass break events but is improbable in physical contact events without glass breakage.

The above-described characteristic waveform patterns provide additional discriminatory advantages and may be analyzed to enable or disable an alarm signal. The preferred embodiment includes slope analyzer 40 and peak slope analyzer 42 to perform such analyses.

Figure 7:
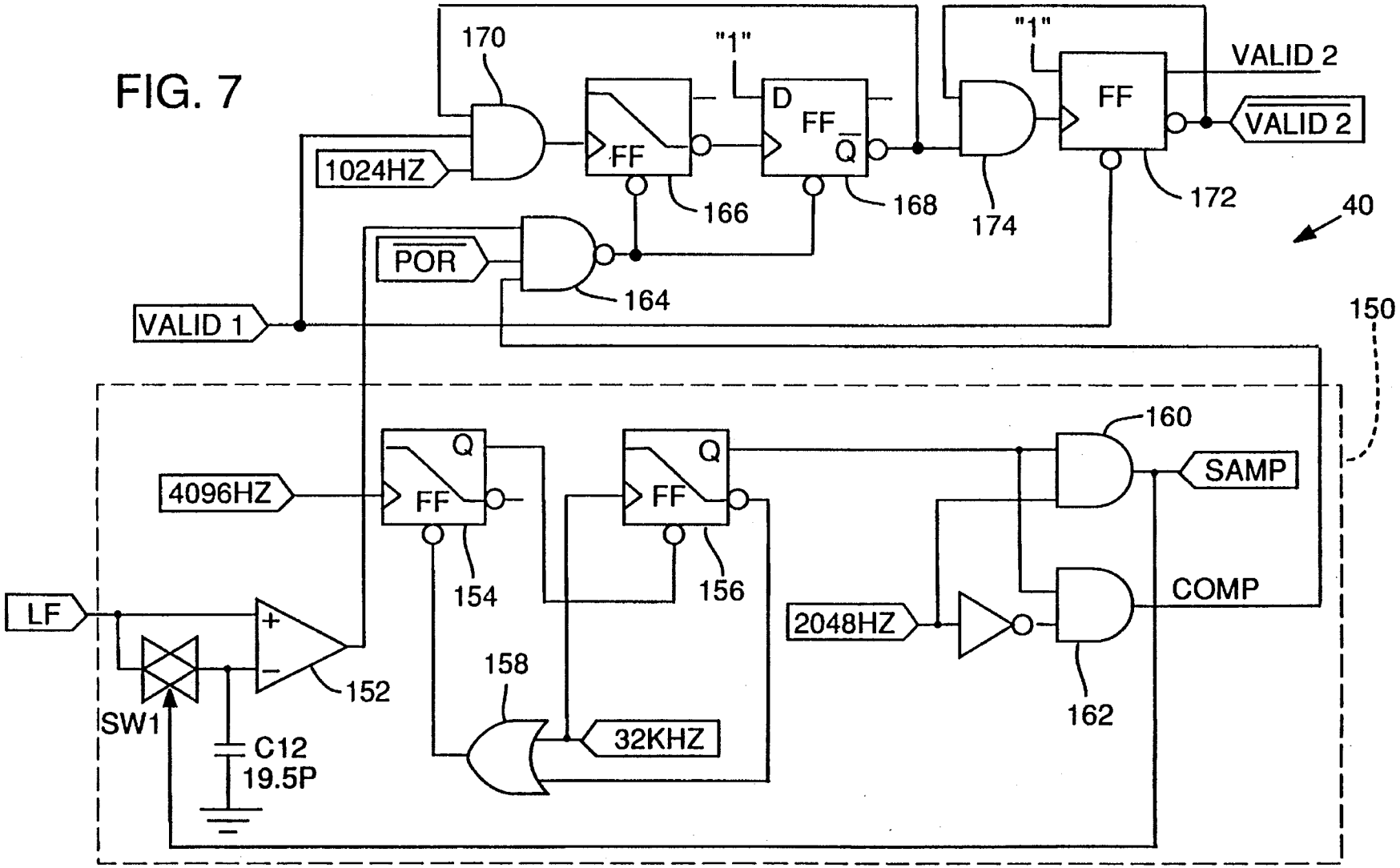
FIG. 7 depicts a slope analyzer circuit that is capable of determining whether the signal appearing at the output of the low frequency bandpass filter indicates an atypical change in polarity of voltage slope above or below an acoustic background noise level.

FIG. 7 shows slope analyzer circuit 40, which analyzes the LF signal to determine whether its rising and falling portions represent two voltage peaks of the same polarity before the appearance of P2, the voltage peak of the opposite polarity in the second half-cycle. Slope analyzer 40 includes a sample and comparison clock generator 150 that produces 2–180° phase-displaced, 6.25 percent duty-cycle 4096 Hz sample and comparison clocks for processing the LF signal.

Figure 8:
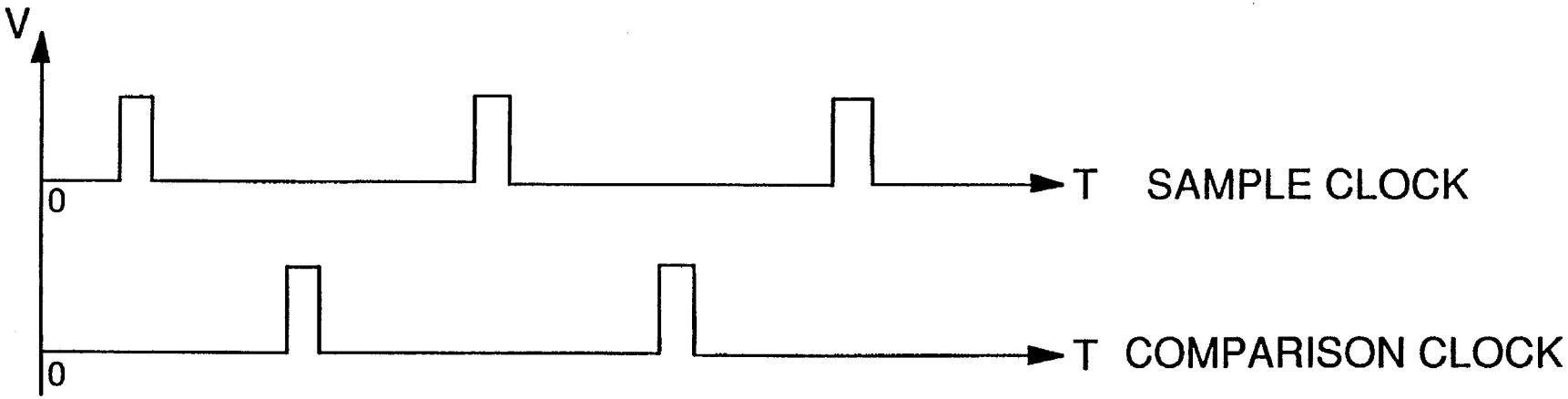
FIG. 8 shows the phase relationship of sample and comparison clock signals used by the slope analyzer subcircuit.

With reference to FIG. 7, clock generator 150 includes a comparator 152 whose noninverting and inverting inputs receive, respectively, the LF signal and a sampled version of the LF signal. The sampling function is accomplished by a bidirectional FET switch SW1 that opens and closes in response to the sample clock is applied to the control gate of SW1. The sample clock is produced by D flip-flops 154 and 156 whose reset inputs and outputs are directly interconnected and gated through an OR gate 158 and an AND gate 160 with 32 kHz and 2048 Hz signals to produce a 4096 Hz sample clock with a 6.25 percent duty cycle. Applying the Q output of flip-flop 156 and an inverted 4096 Hz clock to the inputs of an AND gate 162 produces at its output the comparison clock, which is the same as but 180° phase-displaced relative to the sample clock. FIG. 8 shows the sample and comparison clocks and the phase relationship between them. The sample and comparison clocks facilitate the analysis of the LF signal in the following manner.

Whenever the sampling clock closes switch SW1, the voltages applied to the inputs of comparator 152 are the same and its output is logic 0. During this time, a 19.5 pf capacitor C12 stores the LF signal voltage. Whenever the sampling signal opens switch SW1, a time-varying change in the LF signal voltage is compared against the voltage stored across capacitor C12 immediately before switch SW1 opened. The output of comparator 152 is in logic 1 or logic 0, depending upon whether the LF signal voltage is, respectively, greater or less than the voltage across capacitor C12.

The output of comparator 152 is applied to an input of a 3-input NAND gate 164, whose other inputs receive a power-on reset (POR) signal and the comparator clock and whose output is connected to the reset inputs of D flip-flops 166 and 168. Because the power-on reset is normally in logic 1, the output of NAND gate 164 is in logic 0 whenever the LF signal is of increasing voltage (i.e., logic 1 output of 152 indicates positive slope) and logic 1 whenever the LF signal is of decreasing voltage (i.e., logic 0 output of comparator 152 indicates negative slope). Flip-flop 166 receives a 1024 Hz clock signal from the output of a 3-input AND gate 170 to operate as a divide-by-two counter whenever the VALID 1 signal is in logic 1 and flip-flop 168 is reset. Flip-flop 168 is reset whenever the output of NAND gate 164 is logic 0 (i-e., when LF signal is of increasing voltage) or whenever the output of NAND gate 164 is in logic 1 and before the output of AND gate 170 clocks flip-flop 166. Thus, if the output of comparator 152 is in logic 1 when the comparator clock is in logic 1, the LF signal is of positive voltage slope and flip-flops 166 and 168 are reset. The $\overline{Q}$ output of flip-flop 168 is in logic 1 and thereby enables the 1024 Hz signal to pass to the output of AND gate 170, to which the flip-flops 166 and 168 in reset do not respond. If the output of comparator 152 is in logic 0 when the comparator signal is in logic 1, the LF signal voltage is of negative voltage slope and flip-flops 166 and 168 are taken out of reset and thereby are enabled to respond to the 1024 Hz signal appearing at the output of AND gate 170.

Because flip-flops 166 and 168 clock during the negative voltage slope of the LF signal, two cycles of the 1024 Hz clock set the $\overline{Q}$ output of flip-flop 168 to logic 0. The next time the output of comparator 152 is in logic 1 when the comparator clock is in logic 1 indicates the change in voltage slope of the LF signal and again resets flip-flops 166 and 168. This provides a VALID 2 signal occurrence that is stored by a D flip-flop 172, whose D input is tied to a logic 1 voltage and whose clock input is driven by the output of an AND gate 174. The VALID 2 signal indicates a condition that is representative of a VALID LF signal. The inputs of AND gate 174 receive the $\overline{Q}$ outputs of flip-flops 168 and 172. Because it receives the VALID 1 signal, the reset input of 172 is reset only when no VALID 2 signal exists.

Upon the occurrence of the first negative voltage slope of the LF signal, the output of AND gate 174 changes from logic 1 to logic 0 but flip-flop 172 remains reset. Upon the occurrence of a subsequent change in voltage slope of the LF signal, the output of AND gate 174 changes from logic 0 to logic 1, thereby setting the Q output of flip-flop 172 to logic 1 to develop the VALID 2 signal. Because it is in logic 0, the $\overline{Q}$ output of flip-flop 172 prevents the output of AND gate 174 from changing logic state until the VALID 1 signal again resets flip-flop 172. The VALID 2 signal remains in logic 1 and locks out the peak analyzer circuit 42, which is shown in FIG. 9 and whose operation is described below.

Figure 9:
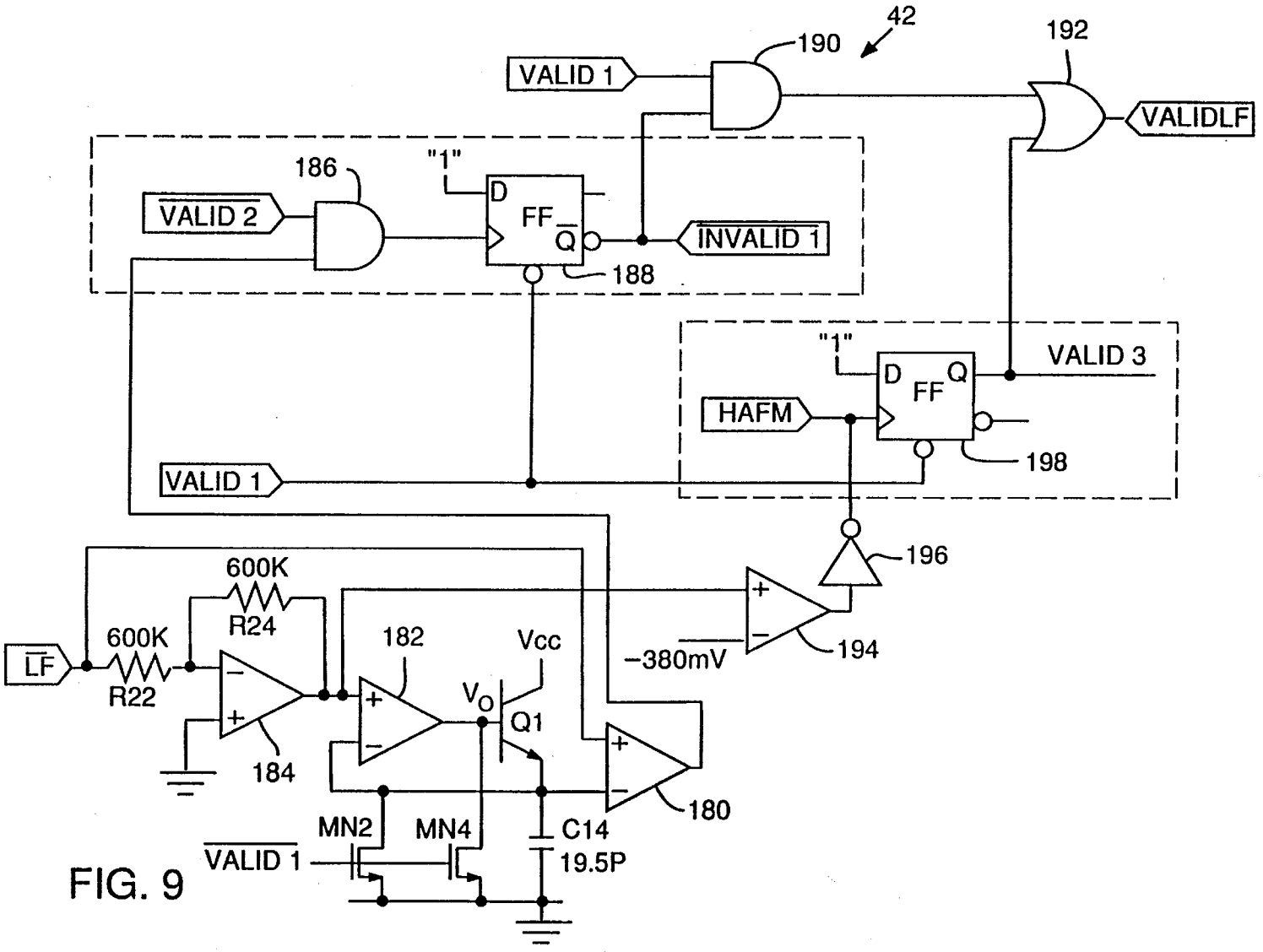
FIG. 9 depicts a peak analyzer circuit that is capable of determining whether the signal appearing at the output of the low frequency bandpass filter is one of the types depicted in FIGS. 6A–6D.

With reference to FIG. 9, peak analyzer 42 operates concurrently with the operation of slope analyzer 40 in the absence of a lock out condition produced by a VALID 2 signal in logic 1. Peak detector 42 determines whether the LF signal has a higher peak absolute value of the first half-cycle (P1) than that of the second half-cycle (P2), a condition that also is representative of a VALID LF signal.

Peak analyzer 42 includes a comparator 180 that compares the absolute values of P1 and P2 by comparing the $\overline{LF}$ signal and the voltage stored across a 19.5 pf capacitor C14. The voltage across capacitor C14 is developed by the cooperative functioning of an amplifier 182 and a NPN transistor Q1, whose emitter terminal is applied to the inverting input of amplifier 182 and capacitor C14. Amplifier 182 receives at its noninverting input the LF signal that appears at the output of a unity gain, inverting amplifier 184, which receives at its inverting input the $\overline{LF}$ signal that also is applied to the noninverting input of comparator 180.

Whenever the LF signal is of increasing positive value (e.g., is in the first half-cycle), the output $V_0$ of amplifier 182 forward-biases the emitter-base junction of Q1. These conditions complete the unity gain feedback path around and thereby configure amplifier 182 as a voltage follower; therefore, the instantaneous voltage at $V_0$ less the base-emitter voltage of Q1 appears across capacitor C14. During this time, the $\overline{LF}$ signal applied to the noninverting input of comparator 180 is of decreasing negative value; therefore, the output of comparator 180 is in logic 0.

Whenever the LF signal reverses polarity and becomes of increasing negative value (e.g., is in the second half-cycle), the instantaneous voltage at $V_0$ becomes negative and thereby reverse-biases the base-emitter junction of Q1. These conditions store across capacitor C14 the highest voltage value that appeared during the first half-cycle. During this time, the $\overline{LF}$ signal is of increasing positive value. If the $\overline{LF}$ signal does not exceed the voltage stored across capacitor C14, the output of comparator 180 remains in logic 0. This is the situation in which the absolute value of P1 is greater than that of P2. If the $\overline{LF}$ signal exceeds the voltage stored across capacitor C14, the output of comparator 180 changes to a logic 1. This is the situation in which the absolute value of P2 is greater than that of P1.

The $\overline{\text{VALID 1}}$ signal is applied to the gate terminals of a pair of FETs MN2 and MN4, whose emitter terminals are connected to ground potential and whose drain terminals are connected to, respectively, the inverting input of comparator 180 and the base terminal of Q1. Whenever the $\overline{\text{VALID 1}}$ signal is in logic 0, FETs MN2 and MN4 have no effect on the operation of peak analyzer 42. Whenever the $\overline{\text{VALID 1}}$ signal is in logic 1, FETs MN2 and MN4 conduct current and discharge to ground potential the voltage stored across capacitor C14, thereby resetting peak analyzer 42 in preparation for the first half-cycle of the next succeeding LF signal.

The $\overline{\text{VALID 2}}$ signal and the output of comparator 180 are connected to the inputs of an AND gate 186. If the $\overline{\text{VALID 2}}$ signal is logic 0 (indicating slope analyzer 40 has detected two voltage slope polarity changes) when the output of comparator 180 is in logic 0 or logic 1, the output of AND gate 186, which is connected to the clock input of a D flip-flop 188, remains in logic 0 and prevents the clocking of flip-flop 188. If the $\overline{\text{VALID 2}}$ signal is in logic 1 (indicating slope analyzer 40 has not detected two voltage slope polarity changes) and the output of comparator 180 remains in logic 0 (indicating the absolute value of P1 is greater than that of P2), flip-flop 188 remains reset with its Q output in logic 1. If the $\overline{\text{VALID 2}}$ signal is in logic 1 when the output of comparator 180 changes from logic 0 to logic 1, (indicating the absolute value of P2 is greater than that of P1), flip-flop 188, whose D input is tied to a logic 1, clocks a logic 1 to its Q output.

The $\overline{Q}$ output of 188 and the VALID 1 signal are connected to the inputs of an AND gate 190. The output of AND gate 190 is in logic 1 when VALID 1 is logic 1 and $\overline{Q}$ flip-flop 188 is in logic 1 (indicating slope analyzer 40 had detected two voltage slope polarity changes or slope analyzer 40 had not detected two voltage slope polarity changes but peak analyzer 42 determined that P1 is greater than P2). The output of AND gate 190 is in logic 0 when either VALID 1 is logic 0 or $\overline{Q}$ of flip-flop 188 is in logic 0 (indicating slope analyzer 40 detected no two voltage slope polarity changes or peak analyzer 42 determined that the absolute value of P2 is greater than that of P1).

The output of AND gate 190 is applied to an input of an OR gate 192, whose output represents the VALID LF signal, which indicates a final determination of a glass break event. The other input of OR gate 192 is a VALID 3 signal, which represents the presence of a very large negative-going voltage excursion in the LF signal when the VALID 1 signal is in logic 1 and indicates a glass break event. The LF signal is applied to the noninverting input of a comparator 194, whose inverting input receives a −380 millivolt threshold voltage. Whenever the LF signal drops below the −380 millivolt threshold, the output of comparator 184 changes to a logic 0, which is inverted by an inverter 196 to a logic 1, which in turn clocks a D flip-flop 198. Because the D input of flip-flop 198 is tied to a logic 1, a logic 1 appears at the Q output of flip-flop 198 whenever it is clocked and the VALID signal connected to its reset input is logic 1. The Q output of flip-flop 198 represents the VALID 3 signal.

The VALID LF signal is applied to an input of NAND gate 50 and represents the composite of all of the LF signal conditions that satisfy one of the criteria for a valid glass break event.

Figure 10:
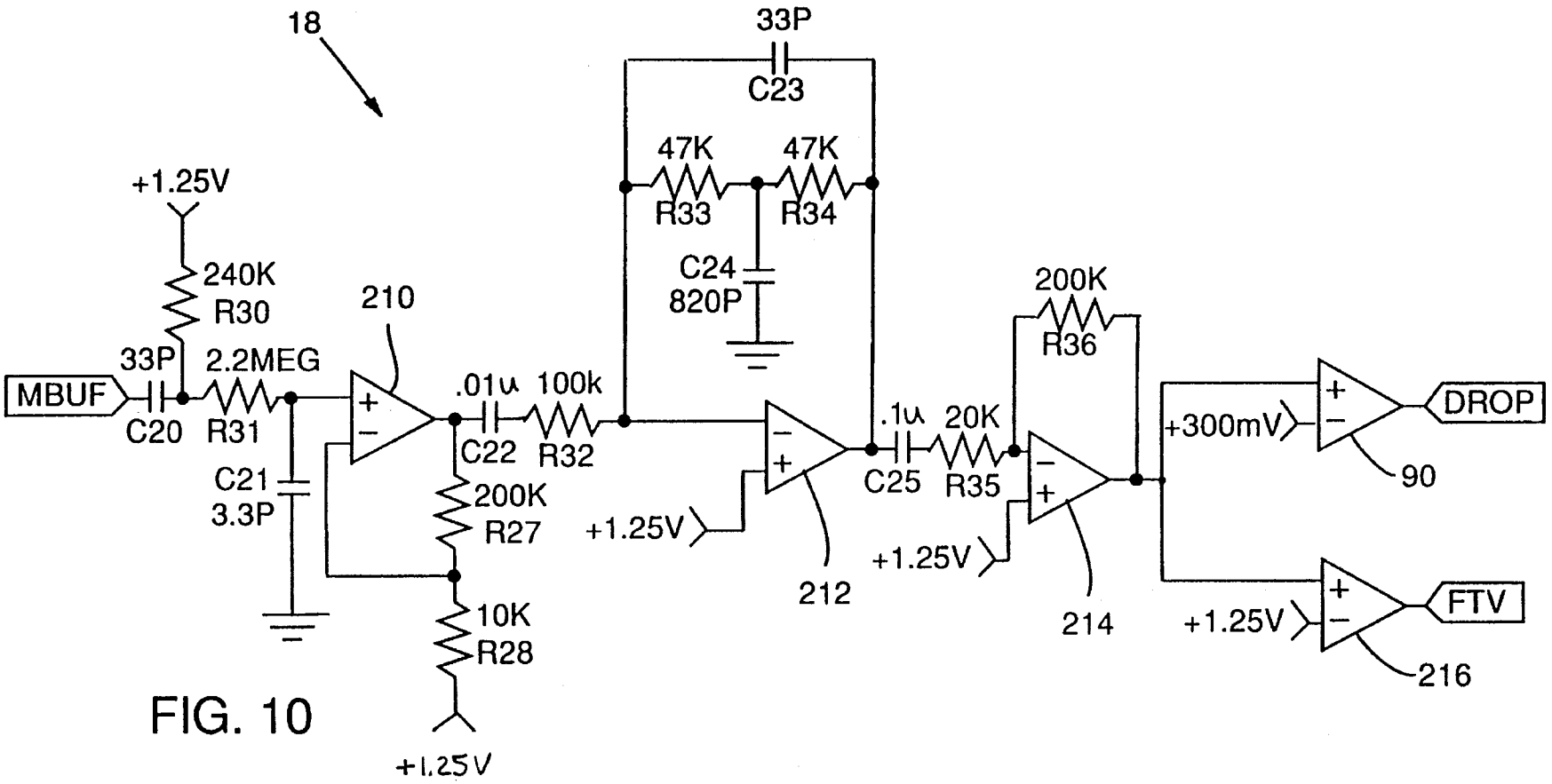
FIG. 10 is a schematic diagram of the HF bandpass filter shown in FIG. 1.

With reference to FIG. 10, the output of buffer amplifier 14 is also coupled to HF filter 18, which includes a passive resistance-capacitance network, an active filter and two amplification stages. HF filter 18 is preferably designed to have a minimum slope of +6 dB per octave for frequencies from 0 Hz to 5 kHz and +12 dB per octave slope for frequencies above 8 kHz. The frequency response of HF filter 18 diminishes at a −12 dB per octave minimum rate for frequencies above 20 kHz to attenuate undesired ultrasonic signals.

The passive resistance-capacitance network includes capacitors C20 and C21; resistors R30 and R31. Capacitor C20 isolates the DC output signal component of buffer amplifier 14 from the circuitry of HF filter 18 and in conjunction with resistor R30 determines a high pass pole near 19 kHz. This emphasizes high frequencies at a rate of +6 dB per octave within a bandwidth of between 0 Hz and 19 kHz. Capacitor C21 in conjunction with resistor R31 determines a low pass pole near 24 kHz, which provides a −6 dB per octave attenuation rate of ultrasonic frequencies. A noninverting amplifier 210 provides voltage gain of about 20.

An active filter including capacitors C22, C23, and C24; resistors R32, R33, and R34; and an amplifier 212 is AC coupled to the output of amplifier 210 and forms a low pass filter with amplitude peaking. Capacitor C22 and resistor R32 determine a sufficiently low high-pass pole near 16 Hz. The feedback path from amplifier 212 peaks the response at 20 kHz and provides an additional +6 dB per octave increase in slope.

An inverting amplifier 214 is AC coupled by capacitor C25 to the output of amplifier 212 and forms a final amplification stage. Amplifier 214 has a gain of about 10 that is set by the ratio of resistor R36 to resistor R35. Capacitor C25 and resistor R35 determine a sufficiently low high-pass pole near 80 Hz. The HF signal appears at the output of amplifier 214 and is applied to the noninverting inputs of comparator 90 and a comparator 216. A +300 millivolt threshold is applied to the inverting input of comparator 90, on whose output appears the DROP signal used by drop out timer 46 (FIG. 3). A 1.25 volt threshold is applied to the inverting input of comparator 216, on whose output appears a FTV signal that is applied to F/V converter 44 for use as described below.

FIG. 11 shows a schematic diagram of F/V converter 44, which receives at the clock input of a D flip-flop 230 the FTV signal developed at the output of comparator 216 (FIG. 10). The FTV signal is a hi-level digitized version of the HF signal. A flip-flop 232 receives a 32 kHz clock signal and receives at its reset input the Q output of flip-flop 230. The reset input of flip-flop 230 is developed by three interconnected NAND gates 234, 236, and 238 that form a logic combination of the 32 kHz clock, the $\overline{Q}$ output of flip-flop 232, and a $\overline{PSET}$ pulse. The $\overline{PSET}$ pulse appears at the output of NAND gate 240, which receives the $\overline{NG}$ and WAKE signals as inputs to produce a 977 microsecond logic 0 pulse at the beginning of the COINCIDENCE period. The resulting Q and $\overline{Q}$ outputs of flip-flop 232 are complementary signal pulse trains, each of which having the period of the FTV signal but with the pulse width of one-half cycle (15.6 microseconds) of the 32 kHz clock. Thus, this combination of logic devices shortens the duty cycle of the FTV signal.

The Q and $\overline{Q}$ outputs of flip-flop 232 are applied to cross-coupled identical sets 242 and 244 of series-connected logic gates to provide two nonoverlapping, phase-displaced, pulse train signals, each of which representing the FTV signal frequency. The F01 and F02 outputs of the respective gate sets 242 and 244 control the operation of a constant-current source to perform the frequency-to-voltage conversion.

To accomplish frequency-to-voltage conversion of the FTV signal, a gated voltage reference subcircuit 250 provides at the drain terminal of a FET MN6 a +0.5 volt reference that is applied to the noninverting input of an amplifier 252 of a constant-current source 254. The WAKE signal applied to the gate terminal of FET MN8 gates the 0.5 volt reference during the NG period, thereby activating constant-current source 254. The nonoverlapping F01 and F02 signals applied to the gate terminals of FETs MN10 and MN12 cause the flow of current of constant-current source 254 through different paths. Whenever the F01 signal is in logic 1, current flows through a resistor R40, across which develops a voltage that also charges a capacitor C30. Whenever the F02 signal is in logic 1, current flows through FET MN12, thereby causing the voltage stored across capacitor C30 to discharge through resistor R40. The RC time constant for capacitor C30 and resistor R40 is about 12 milliseconds; therefore, the FTV signal must be of sufficiently high frequency to maintain a specified voltage stored across capacitor C30.

To provide an initial voltage across capacitor C30, an initializing reference voltage subcircuit 256 provides across capacitor C30 a +300 millivolt reference in response to the logic state of the $\overline{PSET}$ pulse. Whenever the 977 microsecond $\overline{PSET}$ pulse is in logic 0, an inverter 258 provides a 977 microsecond logic 1 pulse to the gate terminal of a FET MN14 and a 977 microsecond logic 0 pulse to the gate terminal of a FET MN16 to initially charge capacitor C30 to +300 millivolts. Afterwards, the frequency of the FTV will determine the instantaneous voltage across capacitor C30 during the NG period. The $\overline{\text{WAKE}}$ signal applied to the gate terminal of a FET MN18 discharges capacitor C30 during the time outside of the NG period.

A comparator 260 receives at its inverting input a +250 millivolt reference and at its noninverting input the voltage stored across capacitor C30. The output of comparator 260 is the FVC signal, which is logic 1 whenever the FTV signal is of sufficiently high frequency to maintain the voltage stored across capacitor C30 above the +250 millivolt threshold. The FVC signal is applied to the SET input of a NAND gate 268, which is cross-coupled with a NAND gate 270 to form a latch. The LATCHDISABLE and NG signals are applied through AND gate 272 to the reset input of NAND gate 270. The LATCHDISABLE signal is in logic 0 during the COINCIDENCE period to disable the latch. The ACOUSTIC output of NAND gate 270, which constitutes the output of F/V converter 44, is applied to one of the inputs of NAND gate 50, is normally in logic 1 but will change to logic 0 whenever the FVC signal switches to logic 0. The FVC signal in logic 0 represents the absence of an HF signal of sufficient amplitude and frequency to represent a valid glass break. An ACOUSTIC output in logic 0 will not enable alarm logic 52.

Figure 12:
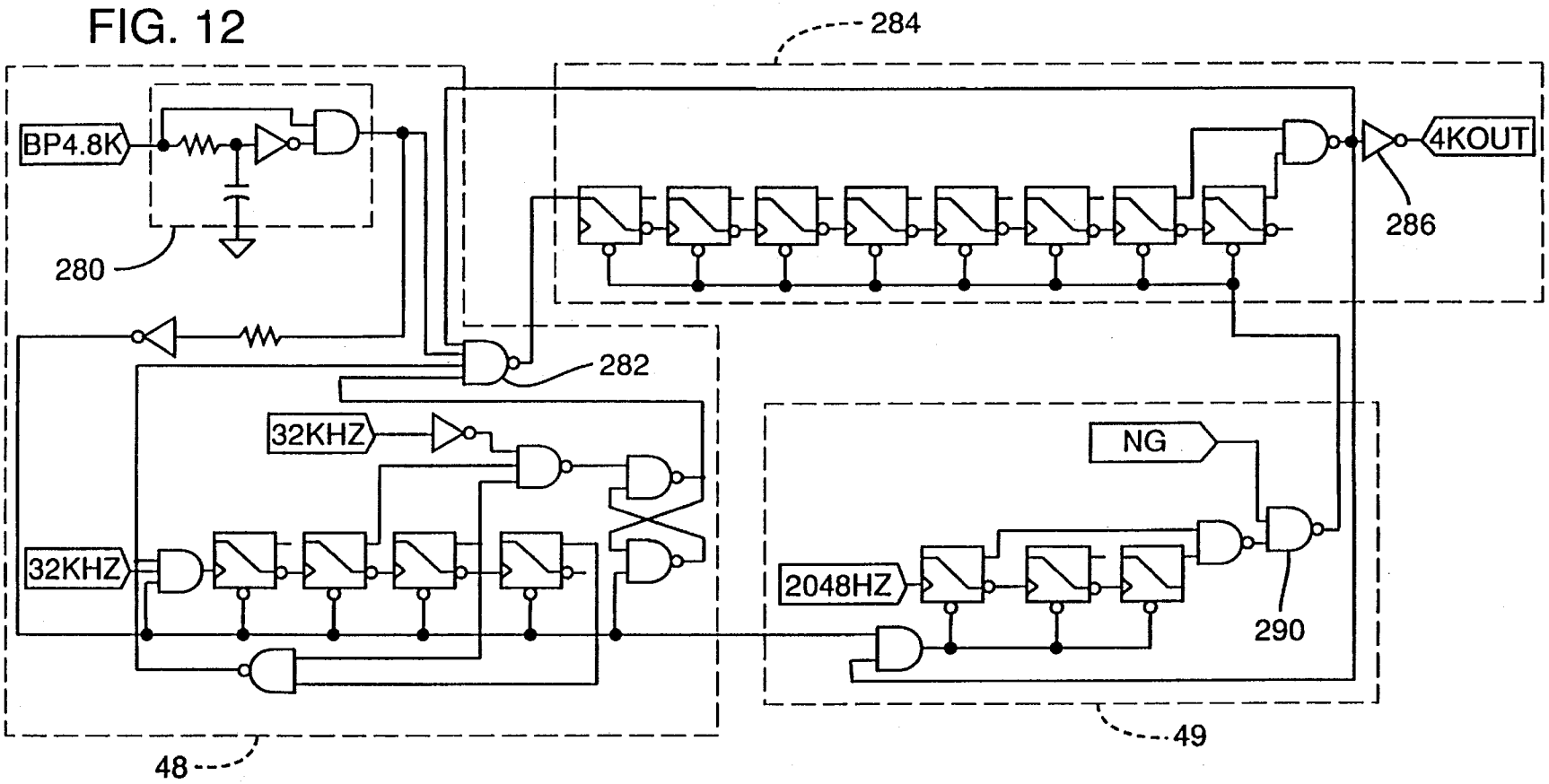
FIG. 12 is a logic diagram of the 4.8 kHz bandpass filter and drop out timer shown in FIG. 1.

FIG. 12 shows a logic diagram of digital bandpass filter 48 with a 4.8 kHz center frequency, which receives at an input of a pulse generator 280 the BP4.8K signal developed at the output of comparator 58 (FIG. 2). Pulse generator 280 is of similar design to that of the pulse generator described for LF logic circuit 26 (FIG. 5). Digital filter 48 measures the period of the BP4.8K signal to determine whether the period is between 3 kHz and 6 kHz and provides at the output of a NAND gate 282 a pulse for each period of the BP4.8K signal that falls within the 3 kHz and 6 kHz range. The flip-flops and gates of digital filter 48 are connected in accordance with conventional digital design techniques to not provide an output pulse for a BP4.8K signal either below 3 kHz or above 6 kHz. The pulses presented at the output of NAND gate 282 and therefore of digital filter 48 are applied to a binary counter subcircuit 284, which provides on the output of an inverter 286 a 4.8KOUT signal in logic 1 whenever a counter 284 counts 192 pulses provided by digital filter 48.

A drop out timer 49 develops at the output of an AND gate 290 a logic 0 reset signal for counter subcircuit 284 under certain circumstances. The NG signal applied to an input of AND gate 290 resets counter subcircuit 284 at the end of the 78 millisecond NG period; therefore, counter subcircuit 284 must count 192 pulses before the NG period ends. The gated outputs of the flip-flops interconnected as a frequency divider chain in drop out timer 49 develop a drop out time of 5 cycles (about 2.4 milliseconds) of the 2048 Hz clock developed in timing logic circuit 24 (FIG. 3). Drop out timer 49 will develop a reset pulse for counter subcircuit 284 if the former receives no pulse from the output of digital filter 48 in a 2 millisecond interval. Should it be reset before it reaches 192 counts during the NG period, counter subcircuit 284 resumes counting from a 0 total count. Thus, the 192 counts accumulated by counter subcircuit 284 represents the continuous (i.e., within 2 milliseconds) presence of at least 192 BP4.8K signal pulses upon completion of the NG period.

The 4.8KOUT signal is applied to one of the inputs of NAND gate 50 and is in logic 1 whenever counter subcircuit 284 has at least 192 counts at the end of the NG period to represent a valid glass break. A 4.8KOUT signal in logic 0 will not enable alarm logic 52.

Figure 13:
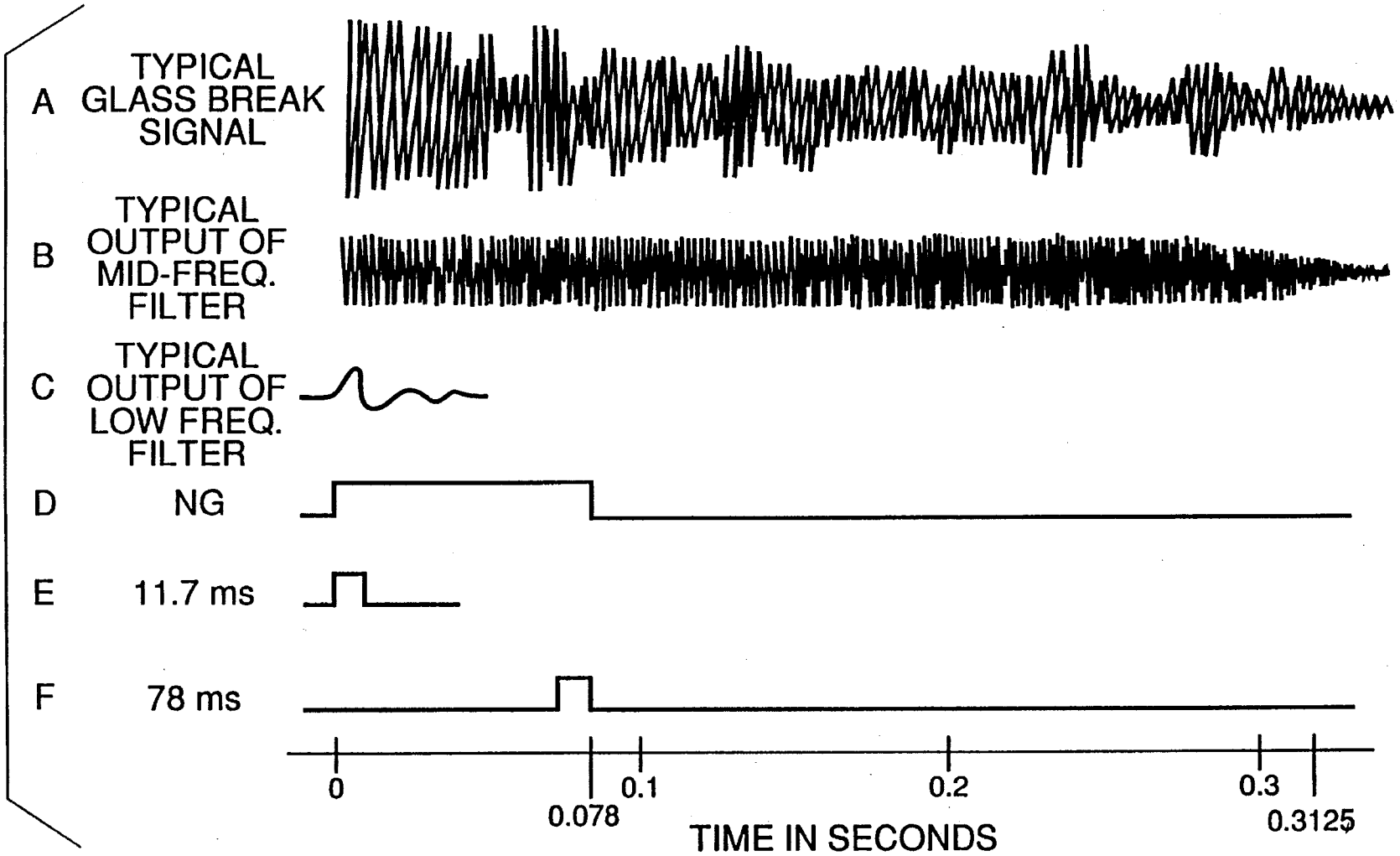
FIG. 13 presents waveform diagrams illustrating the timing relationships of certain signals produced in response to a typical glass break event.

FIG. 13 illustrates the timing relationships of certain signals produced by detector system 10 in response to a typical glass break event. With reference to FIG. 13, a glass break signal (line A) produced by microphone 12 typically generates a MF signal (line B) and an LF signal (line C). The NG signal (line D) and COINCIDENCE signal (line E) are generated in the time relationship shown. Because the break event is in the correct frequency range and is of sufficient amplitude to trigger timing logic circuit 24, the LF signal achieves a sufficiently high voltage within the 11.7 millisecond COINCIDENCE period to set the latch formed by cross-coupled NAND gates 120 and 122 at the output of LF logic circuit 26. The time between the end of the COINCIDENCE period and the end of the VERIFICATION pulse at 78 milliseconds (line F) represents the period during which the VALID LF, ACOUSTIC, and 4.8KOUT signals can switch to logic 1 states. If, however, one of these signals is in logic 0 upon the completion of the VERIFICATION pulse at 78 milliseconds, alarm logic circuit 100 will not be enabled. The NG signal can be reset any time the HF signal drops below the glass break threshold for greater than 15.6 milliseconds.

It will be appreciated that various clock and other timing signals and voltages used herein are generated by circuits not shown. For example, POR and $\overline{\text{POR}}$ signals shown in the figures are reset signals generated upon power-up of the system by the power supply in accordance with circuit design techniques well known to those of ordinary skill in the art.

It will be obvious to those having skill in the art that various changes may be made to the details of the above-described embodiment of the present invention without departing from the underlying principles thereof. For example, detector system 10 could function with greater but possibly acceptable susceptibility to false alarms in the absence of one or more of the functions performed by slope analyzer 40, digital filter 48 and drop out timer 49, or certain others of the signal processing techniques disclosed. Moreover, the detector system could be used to detect the penetration of contact-sensitive surfaces other than glass, and transducer 12 may be of other than an acoustic wave type, such as shock wave, that indicates surface motion. The scope of the invention should, therefore, be determined only by the following claims.

I claim:

1. A detector system for detecting penetration of a contact-sensitive surface, comprising:

a transducer for detecting a low frequency wave of changing amplitude resulting from a contact force applied to the surface;

a low frequency detector for generating a low frequency signal derived from the low frequency wave, the low frequency signal having at least first and second consecutive amplitude peaks that are of opposite polarity relative to a reference level and the first amplitude peak of the low frequency signal reaching a predetermined threshold, the low frequency detector including low frequency circuitry characterized by a low frequency saturation amplitude, the low frequency circuitry operating such that the detector system produces an enable signal when any one of the following conditions occurs: the absolute value of the first amplitude peak is greater than the absolute value of the second amplitude peak, an intervening amplitude peak of the same polarity as that of the first amplitude peak appears between the first and second amplitude peaks and thereby produces a change in polarity of the slope of the low frequency signal after the first amplitude peak but before the second amplitude peak, or the value of an amplitude peak occurring after the first amplitude peak reaches the negative value of the low frequency saturation amplitude; and an alarm responsive to the enable signal.

2. The detection system of claim 1 in which the low frequency detector includes a low frequency filter that derives the low frequency signal from the low frequency wave, the detector system further comprising:

a mid-frequency bandpass filter having a center frequency that exceeds frequencies passed by the low frequency filter, the mid-frequency filter detecting a mid-frequency acoustic wave characteristic of breaking glass; and a logic circuit for providing a signal to which the alarm is responsive whenever the low frequency detector detects during a predetermined time period the occurrence of any one of the conditions that produces the enable signal, the detecting of the mid-frequency acoustic wave initiating the predetermined time period.

3. The detector system of claim 2 in which the low frequency detector detects the occurrence of a low frequency negative-going wave prior to a low frequency positive-going wave and disables the alarm if the low frequency detector does not detect the low frequency positive-going wave during the predetermined time period.

4. The detector system of claim 2 in which the time period ranges from about 10 to 12 milliseconds.

5. The detector system of claim 1 in which the low frequency wave is either a shock or pressure wave.

6. The detector system of claim 1 in which the surface comprises glass.

7. A detector system for detecting penetration of a contact-sensitive surface, comprising:

a transducer for detecting, and developing a motion signal indicative of, a wave of changing amplitude produced in response to motion resulting from a contact force applied to the surface;

a peak analyzer responsive to the motion signal for determining amplitude peaks in the motion signal, the peak analyzer providing a valid signal whenever the absolute value of a first amplitude peak is greater than the absolute value of a second amplitude peak, the first and second amplitude peaks being consecutive amplitude peaks of the motion signal that are of opposite polarity relative to a reference level and the first amplitude peak reaching a predetermined threshold, or whenever the second amplitude peak reaches a negative value that equals a predetermined negative threshold; and an alarm responsive to the valid signal.

8. The detector system of claim 7, further comprising a slope analyzer for analyzing the motion signal and for producing the valid signal upon determining the occurrence of an intervening amplitude peak of the same polarity as that of the first amplitude peak, the intervening amplitude peak appearing between the first and second amplitude peaks and thereby producing a change in polarity of the slope of the motion signal after the first amplitude peak but before the second amplitude peak.

9. A detector system for detecting penetration of a contact-sensitive surface, comprising:

a transducer for detecting, and developing a motion signal indicative of, a wave of changing amplitude produced in response to motion resulting from a contact force applied to the surface;

a low frequency detector comprising a low frequency filter responsive to the motion signal for generating a low frequency motion signal and a peak analyzer responsive to the low frequency motion signal for determining amplitude peaks in the low frequency motion signal, the peak analyzer providing a signal whenever the absolute value of a first amplitude peak is greater than the absolute value of a second amplitude peak, the first and second amplitude peaks being consecutive amplitude peaks of the low frequency motion signal that are of opposite polarity relative to a reference level and the first amplitude peak reaching a predetermined threshold; and an alarm responsive to the signal provided by the peak analyzer.

10. The detection system of claim 9 further comprising:

a mid-frequency bandpass filter having a center frequency that exceeds frequencies passed by the low frequency filter, the mid-frequency bandpass filter detecting a mid-frequency acoustic wave characteristic of breaking glass from the motion signal; and a logic circuit for providing a signal to which the alarm is responsive whenever the low frequency detector detects during a predetermined time period that the absolute value of the first amplitude peak is greater than the absolute value of the second amplitude peak, the detecting of the mid-frequency acoustic wave initiating the predetermined time period.

11. The detector system of claim 10 in which the low frequency detector detects the occurrence of a low frequency negative-going wave prior to a low frequency positive-going wave and disables the alarm if the low frequency detector does not detect the low frequency positive-going wave during the predetermined time period.

12. The detector system of claim 10 in which the predetermined time period ranges from 10 to 12 milliseconds.

13. The detector system of claim 9 in which the low frequency detector further includes low frequency circuitry characterized by a low frequency saturation amplitude, the peak analyzer providing a signal to enable the alarm whenever the second amplitude peak reaches a low frequency saturation amplitude of negative value.

14. The detector system of claim 9, further comprising a slope analyzer for analyzing the low frequency motion signal and determining the occurrence of an intervening amplitude peak of the same polarity as that of the first amplitude peak by detecting a change in polarity of the slope of the low frequency motion signal between the first and second amplitude peaks, the slope analyzer producing a signal to enable the alarm upon determining the occurrence of the change in polarity of the slope of the low frequency motion signal.

15. A detector system for detecting penetration of a contact-sensitive surface, comprising:

a transducer for detecting, and developing a motion signal indicative of, a wave of changing amplitude produced in response to motion resulting from a contact force applied to the surface;

a low frequency detector comprising a low frequency filter responsive to the motion signal for generating a low frequency motion signal and a peak analyzer responsive to the low frequency motion signal for determining amplitude peaks in the low frequency motion signal, the peak analyzer providing a signal whenever the absolute value of a first amplitude peak is greater than the absolute value of a second amplitude peak, the first and second amplitude peaks being sequential amplitude peaks of the low frequency motion signal and of opposite polarity relative to a reference level;

an alarm responsive to the signal provided by the peak analyzer; and the low frequency detector further includes low frequency circuitry characterized by a low frequency saturation amplitude, the peak analyzer providing a signal to enable the alarm whenever the second amplitude peak reaches a low frequency saturation amplitude of negative value.

16. A detector system for detecting penetration of a contact-sensitive surface, comprising:

a transducer for detecting, and developing a motion signal indicative of, a wave of changing amplitude produced in response to motion resulting from a contact force applied to the surface;

a low frequency detector comprising a low frequency filter responsive to the motion signal for generating a low frequency motion signal and a peak analyzer responsive to the low frequency motion signal for determining amplitude peaks in the low frequency motion signal, the peak analyzer providing a signal whenever the absolute value of a first amplitude peak is greater than the absolute value of a second amplitude peak, the first and second amplitude peaks being sequential amplitude peaks of the low frequency motion signal and of opposite polarity relative to a reference level;

an alarm responsive to the signal provided by the peak analyzer;

a mid-frequency bandpass filter having a center frequency that exceeds frequencies passed by the low frequency filter, the mid-frequency bandpass filter detecting a mid-frequency acoustic wave characteristic of breaking glass from the motion signal; and a logic circuit for providing a signal to which the alarm is responsive whenever the low frequency detector detects during a predetermined time period that the absolute value of the first amplitude peak is greater than the absolute value of the second amplitude peak, the detecting of the mid-frequency acoustic wave initiating the predetermined time period.

17. The detector system of claim 16 in which the low frequency detector detects the occurrence of a low frequency negative-going wave prior to a low frequency positive-going wave and disables the alarm if the low frequency detector does not detect the low frequency positive-going wave during the predetermined time period.

18. The detector system of claim 16 in which the predetermined time period ranges from 10 to 12 milliseconds.

* * * * *